US008550284B1

(12) United States Patent
Morad et al.

(10) Patent No.: US 8,550,284 B1
(45) Date of Patent: Oct. 8, 2013

(54) APPARATUS TO RETAIN A DISPOSABLE TRASH BAG ON THE TRASH BAG RECEPTACLE PORTION OF A JANITORIAL CART

(75) Inventors: Fred I. Morad, Toluca Lake, CA (US); William P. Camp, Jr., Vanlue, OH (US); George Madres, La Crescenta, CA (US)

(73) Assignee: Worldwide Integrated Resources, Inc., Montebello, CA (US)

( * ) Notice: Subject to any disclaimer, the term of this patent is extended or adjusted under 35 U.S.C. 154(b) by 52 days.

(21) Appl. No.: 13/370,789

(22) Filed: Feb. 10, 2012

(51) Int. Cl.
*B65D 35/14* (2006.01)
*B65D 90/00* (2006.01)
*B65D 90/08* (2006.01)

(52) U.S. Cl.
USPC . 220/495.08; 220/262; 220/315; 220/495.06; 220/908; 220/908.1; 248/98; 248/99; 248/101

(58) Field of Classification Search
USPC ..... 220/260, 262–264, 315, 319, 324, 326, 220/495.01, 495.06, 495.08, 495.1–495.11; 248/95, 97–98, 99–101; D34/5, 7–10
See application file for complete search history.

(56) References Cited

U.S. PATENT DOCUMENTS

| | | | | |
|---|---|---|---|---|
| 5,520,303 | A * | 5/1996 | Bernstein et al. | 220/495.08 |
| 6,131,861 | A * | 10/2000 | Fortier et al. | 248/98 |
| 6,497,423 | B1 | 12/2002 | Perelli | |
| 2010/0294769 | A1 * | 11/2010 | Lee et al. | 220/263 |
| 2012/0325818 | A1 * | 12/2012 | Heller et al. | 220/495.08 |

* cited by examiner

*Primary Examiner* — Mickey Yu
*Assistant Examiner* — Brijesh V Patel
(74) *Attorney, Agent, or Firm* — Thomas I. Rozsa

(57) ABSTRACT

An apparatus which is used to very securely retain a disposable trash bag onto the upper interior circumference of the trash receptacle portion of a janitorial cart. It includes a retaining ring which is securely retained by spring force action against the upper interior rim of the trash receptacle. A trigger mechanism is used to lock the retaining ring in a raised condition over the upper interior circumference so that the open ends of a disposable trash bag are inserted between the retaining ring and the upper interior surface. The trigger mechanism is retained in place by engaging teeth which engage ratcheted receiving teeth. A pair of pushbuttons serve to release the trigger mechanisms so that the return spring force causes the retaining ring to move upwardly and release the entrapped disposable garbage bag.

4 Claims, 22 Drawing Sheets

APPARATUS TO RETAIN A DISPOSABLE TRASH BAG ON THE TRASH BAG RECEPTACLE PORTION OF A JANITORIAL CART

BACKGROUND OF THE INVENTION

1. Field of the Invention

The present invention relates to the field of janitorial carts used by a cleaning person when performing janitorial cleaning services, usually in a commercial building. The present invention specifically focuses on the trash retaining compartment of the janitorial cart and in particular on the apparatus used to retain a disposable trash bag onto the trash compartment of the janitorial cart.

2. Description of the Prior Art

The following patent is relevant to the field of the present invention:

U.S. Pat. No. 6,497,423 issued to Perelli on Dec. 24, 2002 for "Mobile Maintenance Cart Having A Storage Compartment, A Bag Retention System, And A Forward Facing Recess For Supporting A Container". The patent discloses a double U-shaped wire which is used to retain a disposable trash bag between the wire and the top of the trash container receptacle. A physical force by hand is required to engage the wire into the closed position and to release the wire in order to remove the disposable trash bag.

There is a significant need for an improved mechanism to retain the disposable trash bag onto the trash receptacle portion of a janitorial cart.

SUMMARY OF THE INVENTION

The present invention is an apparatus which is used to very securely retain a disposable trash bag onto the upper interior circumference of the trash receptacle portion of a janitorial cart. The present invention includes a retaining ring or wire which is securely retained by spring force action against the upper interior rim of the trash receptacle. A downward force on the retaining ring engages a locking mechanism having retaining teeth to retain the retaining wire against an interior rim of the trash receptacle portion of a janitorial cart.

The open ends of a disposable trash bag are placed over the retaining wire and then around and under the retaining wire so that the trash bag is trapped between the retaining wire and the upper rim of the trash receptacle portion.

The retaining spring force is overcome by a counter force from a cleaning person releasing a spring force retaining mechanism so that a counter spring force raises the retaining ring above the upper interior circumference of the trash receptacle portion. A locking mechanism is used to lock the retaining wire or ring in a raised condition over the upper interior circumference so that the open ends of a disposable trash bag are inserted over the retaining ring and then between the retaining ring and the upper interior surface. A downward force on the retaining wire causes the locking mechanism to be engaged and retain the open ends of the disposable trash bag between the retaining wire and the upper rim of the trash receptacle portion of the janitorial cart. The locking mechanism is retained in place by engaging teeth which engage ratcheted receiving teeth on the present invention.

A pair of pushbuttons serve to release the locking mechanisms so that the return spring force causes the retaining ring to move upwardly and release the engagement with the upper interior circumference, so that the ends of the disposable trash bag which were trapped between the retaining wire and the upper rim can now be removed for trash bag disposal.

It is an object of the present invention to provide a mechanically actuated trash bag retainer which retains the open ends of a disposable trash bag against the upper circumferential rim of the trash bag compartment of a janitorial cart so that the disposable trash bag will remain in its opened condition and will not fall to the bottom of the trash bag compartment as debris, dirt and discarded objects are placed into the disposable trash bag.

It is another object of the present invention to have a locking mechanism by which the retaining wire is locked in an elevated position over the interior rim of the trash bag compartment so that the open ends of a disposable trash bag can be inserted over and around the retaining wire and then between the retaining wire or ring and the upper interior surface so that a downward force causes the retaining wire to entrap the open ends of the trash bag between the retaining wire and the upper rim of the trash bag receptacle.

It is a further object of the present invention to provide means to release the locking mechanism so that a return spring force causes the retaining ring to move upwardly and rest above the upper interior surface of the trash bag compartment, thereby releasing the open ends of the disposable trash bag between the retaining ring and the upper interior surface of the trash bag compartment so that the disposable trash bag which is now filled with trash can be removed and replaced with a new disposable trash bag.

It is a further object of the present invention to provide a trash bag retainer which retains the open ends of a disposable trash bag in a secure manner against the upper interior circumference of the trash bag compartment to provide a mechanically actuated disposable trash bag retainer incorporated into the trash bag retaining compartment of a janitorial cart.

It is an additional object of the present invention to provide a one-piece ring which securely retains the open ends of a disposable trash bag against the upper circumferential rim of the trash bag retainer compartment.

It is also an object of the present invention to provide a spring actuated retaining means whereby a locking mechanism engages the spring actuated retaining means to place the retaining ring in an opened condition above the upper rim of the trash bag receptacle to facilitate removal of a filled disposable trash bag and to insert the open ends between the retaining ring and the upper circumferential wall and close the retaining ring against the upper circumferential rim by releasing the locking mechanism and causing a spring force closing action to retain the open ends of the disposable trash bag between the retaining ring and the upper interior circumference of the trash bag receptacle portion of the janitorial cart.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
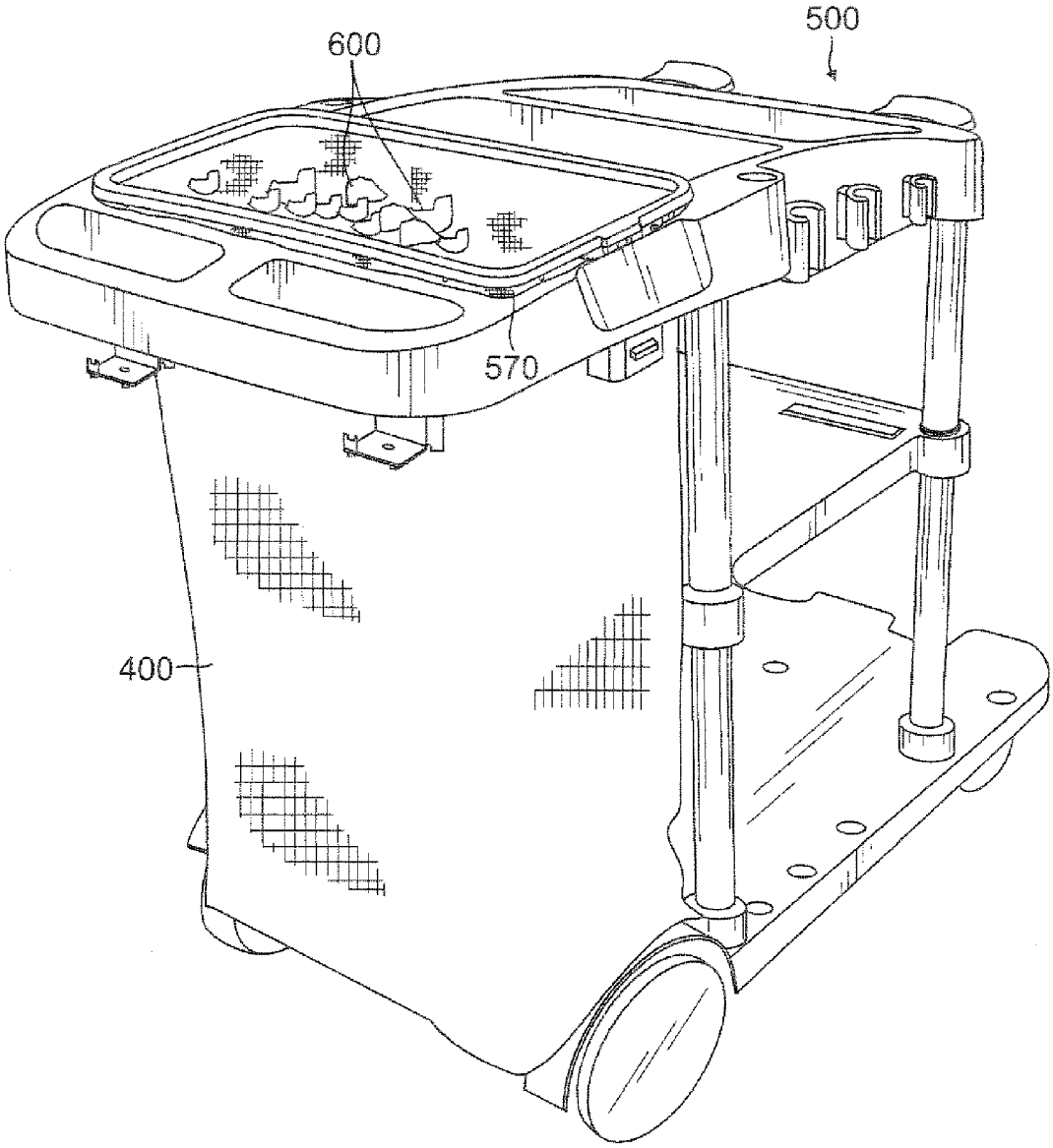
FIG. 1 is perspective view of the present invention to retain a disposable trash bag in the trash bag retaining compartment of a janitorial cart illustrating the retaining ring in the activated condition to retain a disposable trash bag at its open ends entrapped between the retaining ring and the interior circumference of the trash receptacle portion.
Figure 4:
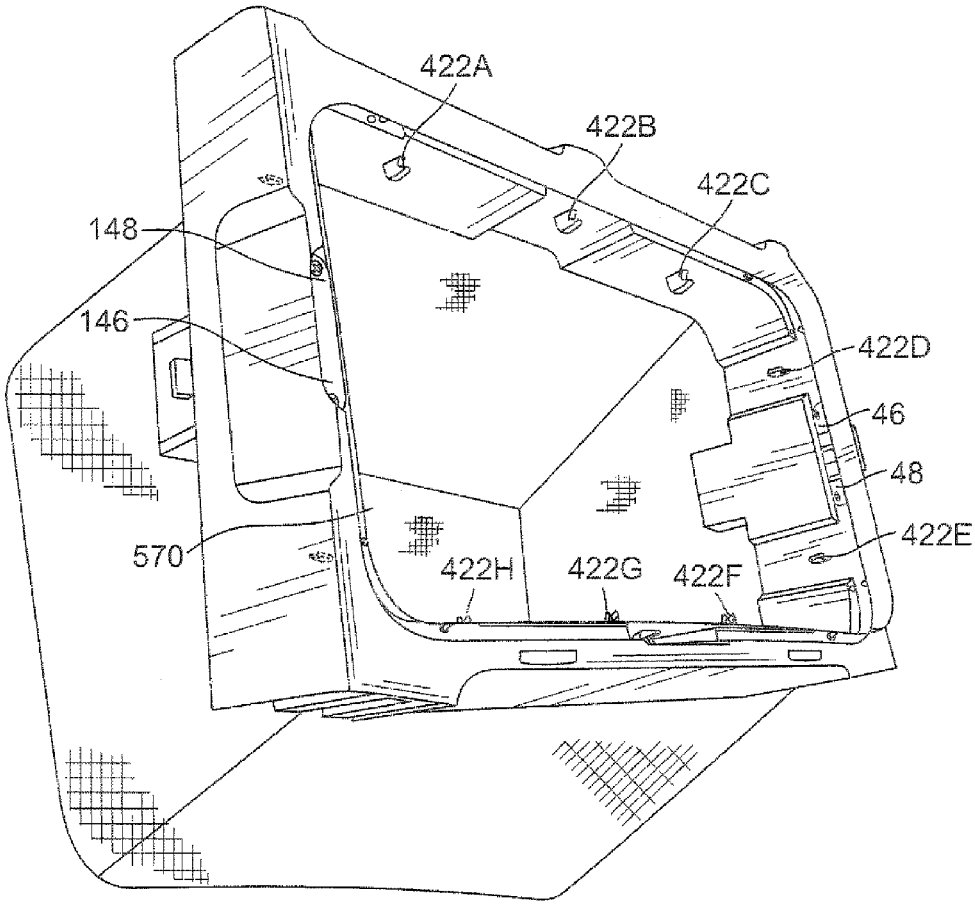
FIG. 4 is a top perspective view of the janitorial cart illustrating the "J" hooks used to retain the trash bag receptacle through a respective grommet on the trash bag receptacle affixed to a respective "J" hook.
Figure 4A:
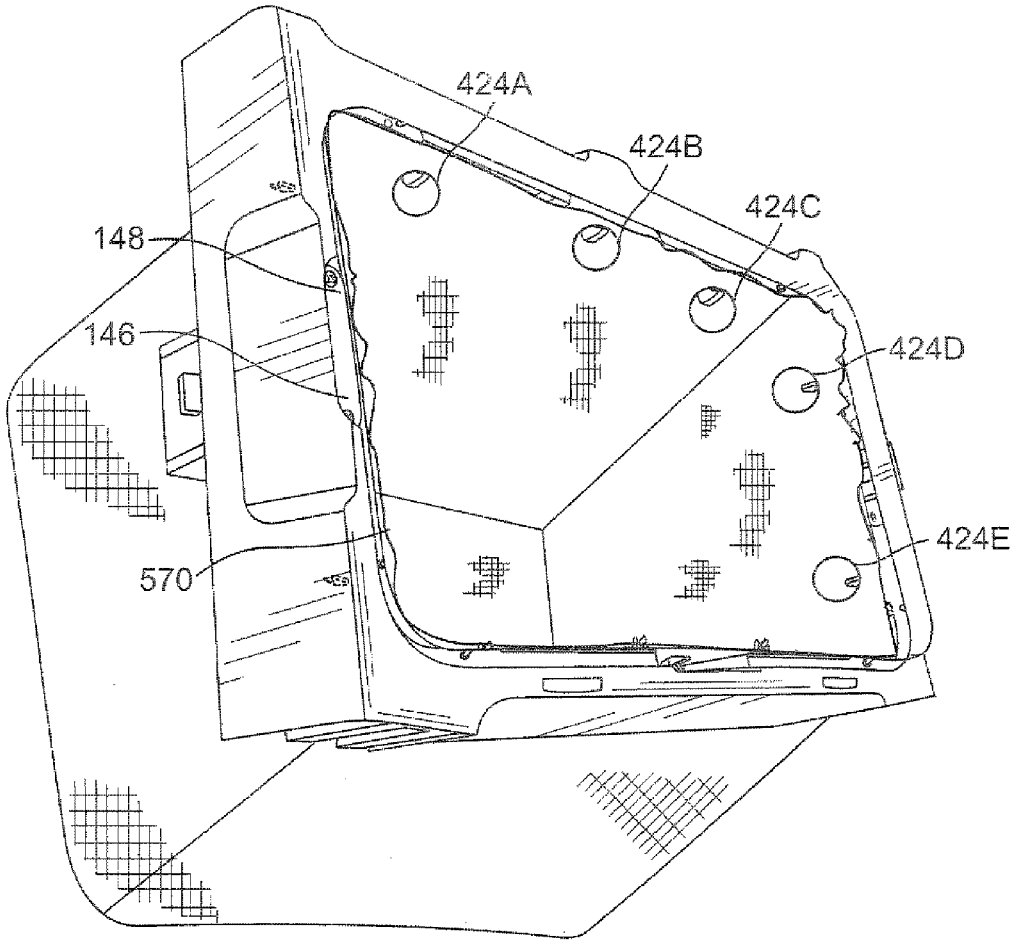
FIG. 4A is a top perspective view of the present invention disposable trash bag retaining assembly removed from the janitorial cart to better illustrate the interior components, illustrating several of the "J" hooks affixed to the interior surface of the janitorial cart and a respective grommet from a trash bag receptacle placed over a respective "J" hook to retain the trash bag receptacle into the janitorial cart.

Referring to FIG. 1, there is illustrated a conventional janitorial cart 500. For purposes of the present invention, the portion of the janitorial cart 500 to which the present invention pertains is the trash bag retaining receptacle 400 located at the back of the janitorial cart 500. The receptacle 400 is made of flexible strong canvas type material which is affixed to the interior surface 406 of the container section 408 below the janitorial cart rim 420 by conventional affixation means. Referring to FIG. 4, the interior surface 406 comprises a multiplicity of "J" hooks such as 422A, 422B, 422C, 422D, 422E, 422F, 422G and 422H. Two additional "J" hooks are perpendicular to and opposite "J" hooks 422D and 422E. Referring to FIG. 4A, the receptacle further comprises a multiplicity of grommets such as 424A, 424B, 424C, 424D and 424E which are respectively retained on respective "J" hooks 422A, 422B,422C, 422D and 422E. There are additional matching grommets to correspond to the respective "J" hooks to retain the receptacle 400 onto the interior rim 406 of the cart. Into the receptacle 400 is placed a removable and disposable trash bag 570. The rim 572 of the disposable trash bag 570 needs to be retained in a manner so that it will not fall into the trash bag retaining receptacle 400 as it is being filled with trash 600.

The top 410 of the trash container section 400 is illustrated in FIGS. 2, 3, 4, 18 and 19. The top 410 includes an upper interior rim 420 which encircles the interior circumference of the trash container section 400. The upper interior rim 420 includes a first transverse edge 430, a parallel oppositely disposed second transverse edge 450, a first longitudinal lengthwise side 470 and a parallel second longitudinal or lengthwise side 480.

First transverse edge 430 and first longitudinal lengthwise side 470 are connected by first curved section 412. First longitudinal lengthwise side 470 and second transverse edge 450 are connected by second curved section 414. Second transverse edge 450 and second longitudinal lengthwise side 480 are connected by third curved section 416, and second longitudinal lengthwise side 480 and first widthwise edge 430 are connected by curved sections 418. It will be appreciated that upper interior rim 420 is one continuous strip composed of edges, sides and curved sections 430, 412, 470, 414, 450, 416, 480 and 418.

Figure 18:
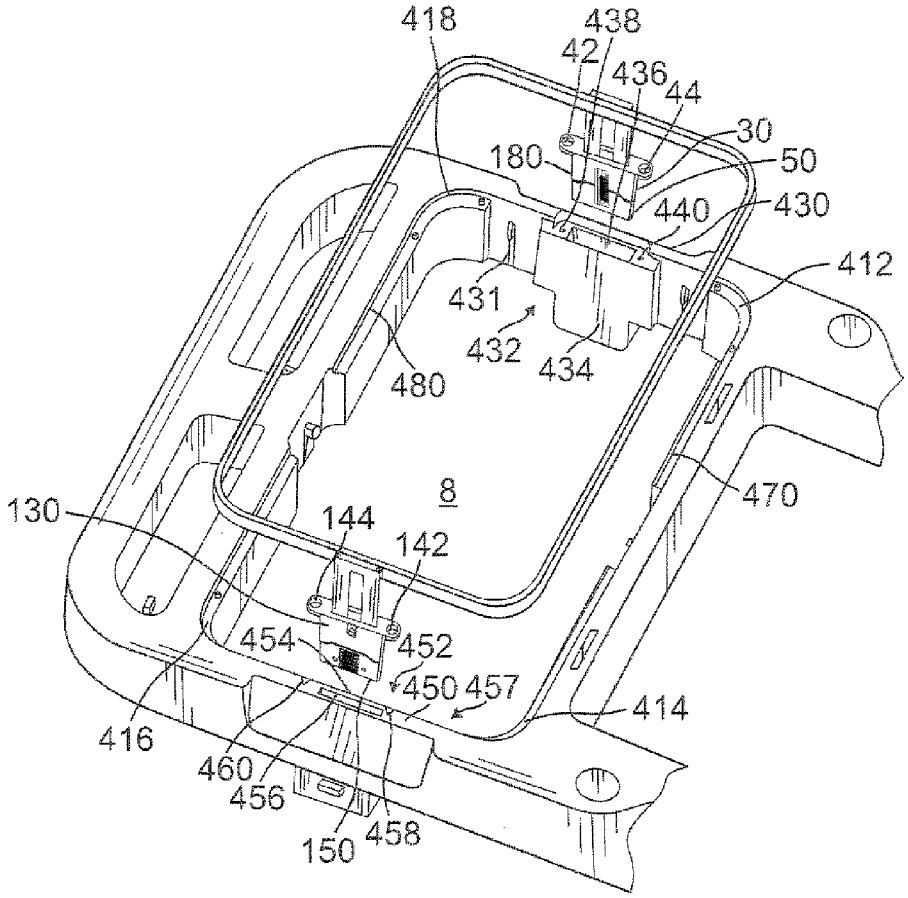
FIG. 18 is an exploded top perspective view of the upper interior circumference of the trash receptacle portion of a janitorial cart also illustrating the activation assembly receiving housing portion affixed to the interior of the circumference, and partially assembled retaining ring and activation assembly components illustrated in FIG. 15 above the trash receptacle portion with a respective activation assembly over a respective activation assembly receiving housing.
Figure 19:
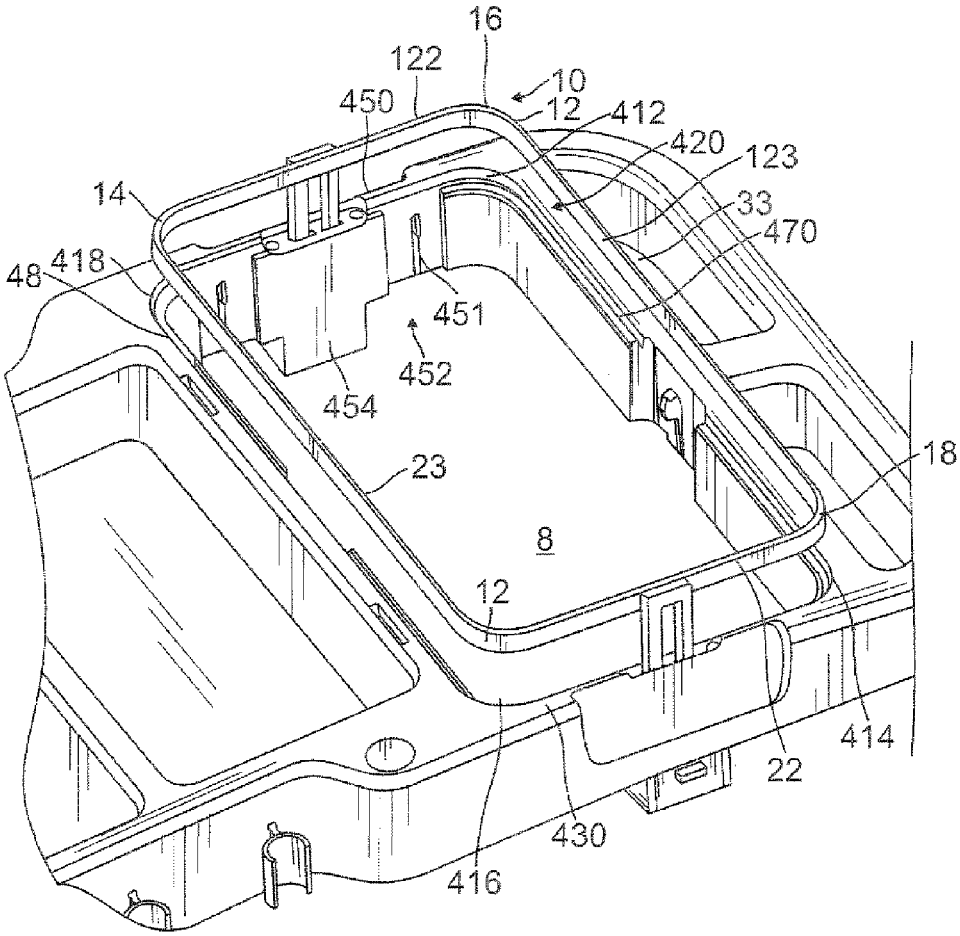
FIG. 19 is a top perspective view of the activation assemblies respectively inserted into a respective activation assembly receiving housing of the upper interior circumference of the trash receptacle portion of a janitorial cart, with the ring in its activated opened condition.
Figure 20:
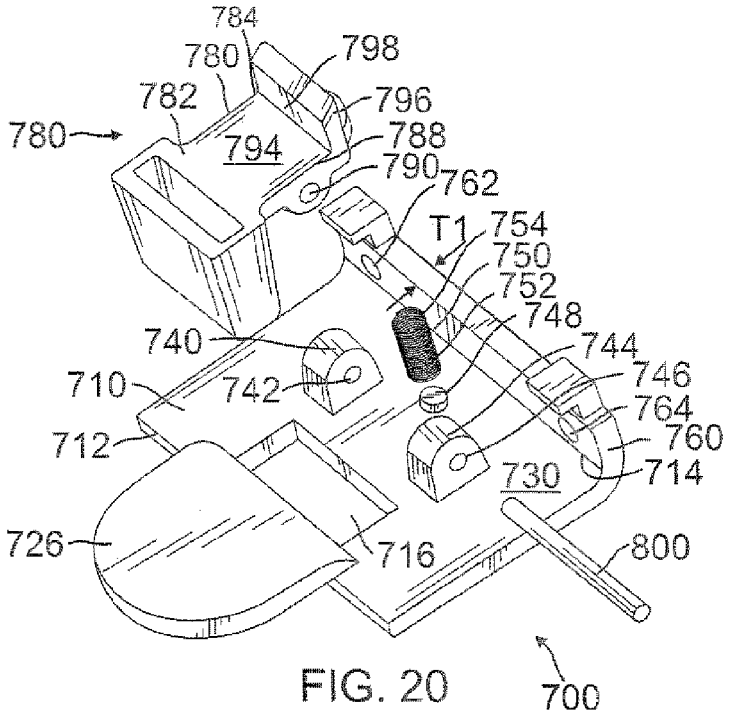
FIG. 20 is an exploded view illustrating the components of a first trigger mechanism of the present invention.
Figure 20A:
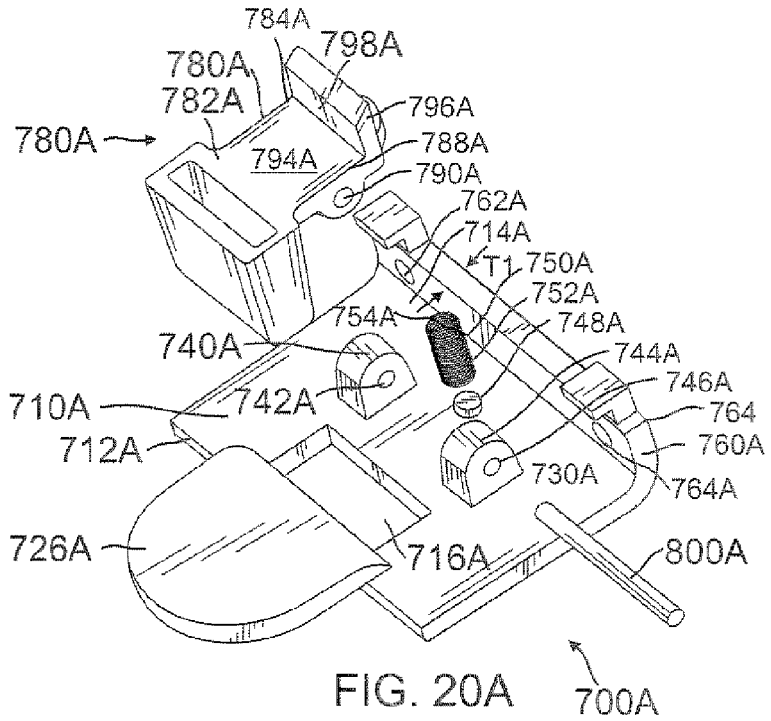
FIG. 20A is an exploded view illustrating the components of a second trigger mechanism of the present invention.
Figure 21:
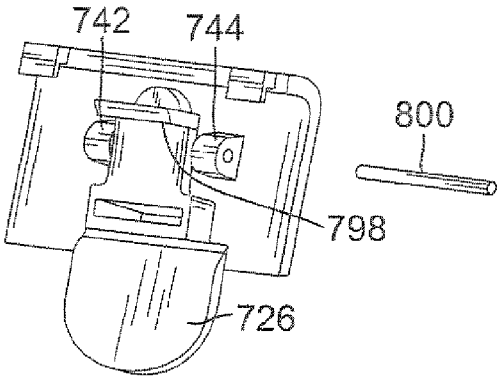
FIG. 21 is a top elevational view of a partially assembled first trigger mechanism of the present invention.
Figure 22:
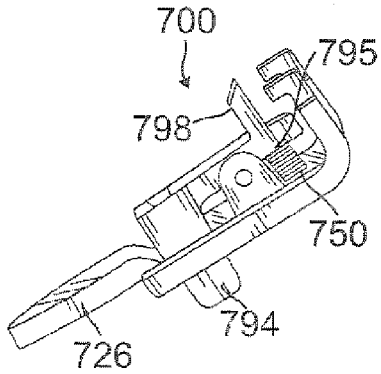
FIG. 22 is a side elevational view of the assembled first trigger mechanism of the present invention.

Referring to FIGS. 18 and 19, the first transverse edge 430 includes a first centrally disposed wire mounting assembly receiving member 432 which includes a body 434 having a central chamber 436 with a first receiving opening 438 to one side of central chamber 436 and a second receiving opening 440 to an opposite side of central chamber 436.

The second transverse edge 450 includes a second centrally disposed wire mounting assembly receiving member 452 which includes a body 454 having a central chamber 456 with a first receiving opening 458 to one side of central chamber 456 and a second receiving opening 460 to an opposite side of central chamber 456. The first wire mounting receiving assembly 432 and the second wire mounting receiving assembly 452 are parallel to each other and are respectively affixed inwardly from the respective interior side 431 of transverse edge 430 and interior side 451 of transverse edge 450, both extending into central opening 8.

The present invention includes a one-piece generally rectangular retaining ring or wire 10 having curved corners 12, 14 16 and 18 so that the retaining wire can be pressed into the interior rim 430 with the top of a disposable trash bag trapped between the upper interior rim 430 and the generally rectangular retaining wire 10.

Referring to FIGS. 7, 8, 9, 10, 11, 12, 13, 14, 15 and 16, the retaining wire 10 has a given thickness or depth "D1". Affixed to a first transverse edge 22 of retaining wire 10 are a pair of spaced apart feet 24 and 26. Foot 24 has an opening 25 adjacent its distal end 24A and foot 26 has an opening 27 adjacent its distal end 26A. First mounting block 30 has a smooth side 32 and a notched side 34 with a central notch 36. Central notch 36 contains a central hook member 37 with an opening 39 which faces the distal end 41 of first mounting block 30. First mounting block 30 is placed onto the feet 24 and 26 through longitudinal channel 38 which extends for the height "H1" of the mounting block 30. The first mounting block 30 has a transverse top section 40 having a pair of spaced apart openings 42 and 44.

A first moving block 50 has a pair of spaced apart channels 52 and 54 which are respectively aligned with feet 24 and 26 so that the first moving block 50 has its channels 52 and 54 respectively placed onto feet 24 and 26 so that the moving block 50 can slide down feet 24 and 26. Referring to FIGS. 13, 14, 15 and 16, the first moving 50 has a ratcheted side 49 and a notched side 56 with a central notch 58. The moving block 50 has a first opening 60 adjacent it distal end 64 and a parallel spaced apart second opening 62. Central notch 58 contains a hook 53 with an opening 55 which faces the distal end 64 of the first moving block 50. The openings 62 and 60 are respectively aligned with openings 25 and 27 in feet 24 and 26. The moving block 50 is affixed to the feet 24 and 26 by a first affixing means 66 which can be a roll pin or screw extending through respective openings 27 and 60 and by a second affixing means 68 which can be a roll pin or screw extending through openings 25 and 62. The notched side 34 of first mounting block 30 and the notched side 56 of first moving block 60 face inwardly toward the central opening 8 in generally rectangular retaining wire 10 so that their respective notches 36 and 58 are aligned. A first tension spring 70 has a hooked first end 72 which is retained into opening 39 of central hook member 37 and a second hooked end 74 which is retained into opening 55 of hook member 53 so that the tension spring 70 movably retains first mounting block 30 to first moving block 50. The combined first mounting block 30 and first moving block 50 and the component parts comprise a first wire mounting assembly 80. The central portion of the ratcheted side 49 of first moving block 50 has a multiplicity of ratchet teeth 51 which face in the direction of the first mounting block 30.

Referring to FIGS. 7A, 8A, 9, 10A, 11A, 12, 13A, 14A, 15A, and 16A, the retaining wire 10 has a second transverse edge 122 which is parallel to first transverse edge 22. Affixed to the second transverse edge 122 of retaining wire 10 are a pair of spaced apart feet 124 and 126. Foot 124 has an opening 125 adjacent its distal end 124A and foot 126 has an opening 127 adjacent its distal end 126A. Referring to FIGS. 7A, 8A, 9A, 10A, 11A, 12A, 13A, 14A, 15A and 16A, second mounting block 130 has a smooth side 132 and a notched side 134 with a central notch 136. Central notch 136 contains a central hook member 137 with an opening 139 which faces the distal end 141 of second mounting block 130. Second mounting block 130 is placed onto the feet 124 and 126 through longitudinal channel 138 which extends for the height "H2" of the mounting block 130. The mounting block 130 has a transverse top section 140 having a pair of spaced apart openings 142 and 144.

A second moving block 150 has a pair of spaced apart channels 152 and 154 which are respectively aligned with feet 124 and 126 so that the second moving block 150 has its channels 152 and 154 respectively placed onto feet 124 and 126 so that the second moving block 150 can slide down feet 124 and 126. The second moving block 150 has a ratcheted side 149 and a notched side 156 with a central notch 158. The second moving block 150 has a first opening 160 adjacent it distal end 164 and a parallel spaced apart second opening 162. Central notch 158 contains a hook 153 with an opening 155 which faces the distal end 164 of the second moving block 150. The openings 160 and 162 are respectively aligned with openings 125 and 127 in feet 124 and 126. The second moving block 150 is affixed to the feet 124 and 126 by a first affixing means 168 which can be a roll pin or screw extending through respective openings 125 and 162 and by a second affixing means 166 which can be a roll pin or screw extending through openings 127 and 160. The notched side 134 of second mounting block 130 and the notched side 156 of second moving block 150 face inwardly toward the central opening 8 in generally rectangular retaining wire 10 so that their respective notches 136 and 158 are aligned. A second tension spring 170 has a hooked first end 172 which is retained into opening 139 of central hook member 137 and a second hooked end 174 which is retained into opening 155 of hook member 153 so that the second tension spring 170 movably retains second mounting block to second moving block 160. The combined second mounting block 130 and second moving block 150 and their component parts comprise a second wire mounting assembly 180. The central portion of the ratcheted side 149 of second moving block 150 has a multiplicity of ratcheted teeth 151 which face in th direction of the second mounting block 30.

The first wire mounting assembly 80 including the first mounting block 30 and first moving block 50 are respectively parallel to the second wire mounting assembly 180 including the second mounting block 130 and second moving block 150.

Referring to FIG. 18, the first mounting block 30 and the first moving block 50 are inserted into the central chamber 436 of first centrally disposed wire receiving member 432 and affixed thereto by aligning opening 42 of first mounting block 30 with first receiving opening 438 and aligning opening 44 of first mounting block 30 with second receiving opening 440 which accommodate first affixing means such as screws 46 and 48 (see FIG. 4) which respectively extend through opening 42 and 438, and 44 and 440 to affix first wire mounting assembly 80 into first centrally disposed wire mounting receiving assembly 432. As a result, the first mounting block 30 is affixed within central chamber 436, its first transverse section 40 is affixed to the body 434 and the first moving block 50 and feet 24 and 26 are movably retained within central chamber 436 of the first centrally disposed wire mounting assembly receiving member 432.

Similarly, referring to FIG. 18, the second mounting block 130 and the second moving block 150 are inserted into the central chamber 456 of second centrally disposed wire receiving member 452 and affixed thereto by aligning opening 142 of second mounting block 130 with first receiving opening 458 and aligning opening 144 of second mounting block 130 with second receiving opening 460 which accommodate second affixing means such as screws 146 and 148 (see FIG. 4) which respectively extend through opening 142 and 458, and 144 and 460 to affix second wire mounting assembly 80 into second centrally disposed wire mounting receiving assembly 452. As a result, the mounting block 130 is affixed within central chamber 456, its first transverse section 140 is affixed to the body 454 and the second moving block 150 and feet 124 and 126 are movably retained within central chamber 456 of the second centrally disposed wire mounting assembly receiving member 432.

Figure 2:
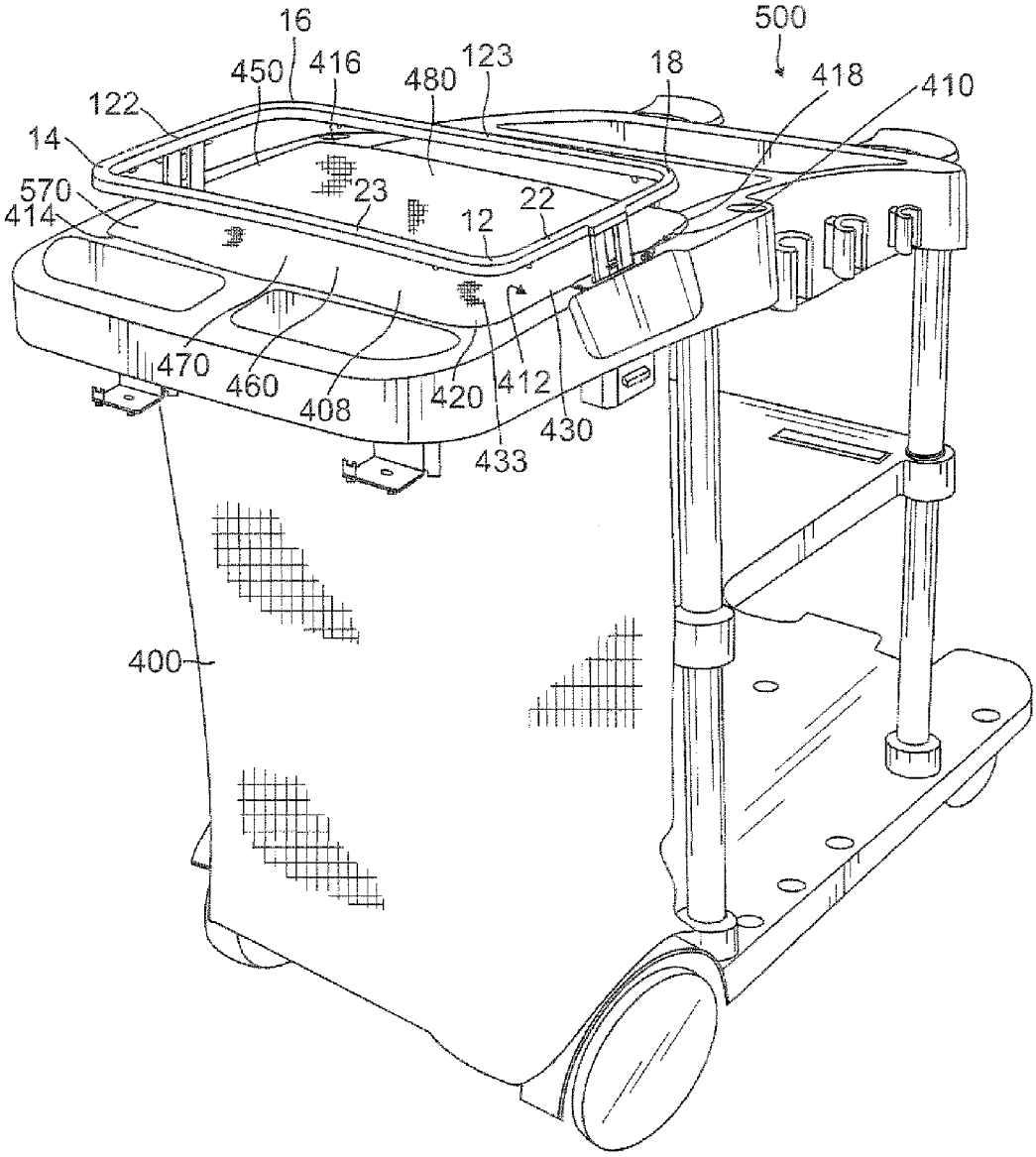
FIG. 2 is a perspective view of the present invention to retain a disposable trash bag in the trash bag retaining compartment of a janitorial cart with the retaining ring in the open condition.

Referring to FIGS. 2 and 19, the generally rectangular retaining wire is made of one-piece and has transverse edges 22 and 122 and lengthwise or longitudinal sides 23 and 123. Edge 22 and lengthwise side 23 are connected by curved section 12, lengthwise side 23 and edge 122 are connected by curved section 14, edge 122 and lengthwise side 123 are connected by curved section 16 and lengthwise side 123 and edge 22 are connected by curved section 18. The entire retaining wire 10 is of one-piece and preferably made of plastic although other materials such as metal or wire are also within the spirit and scope of the present invention.

Figure 5:
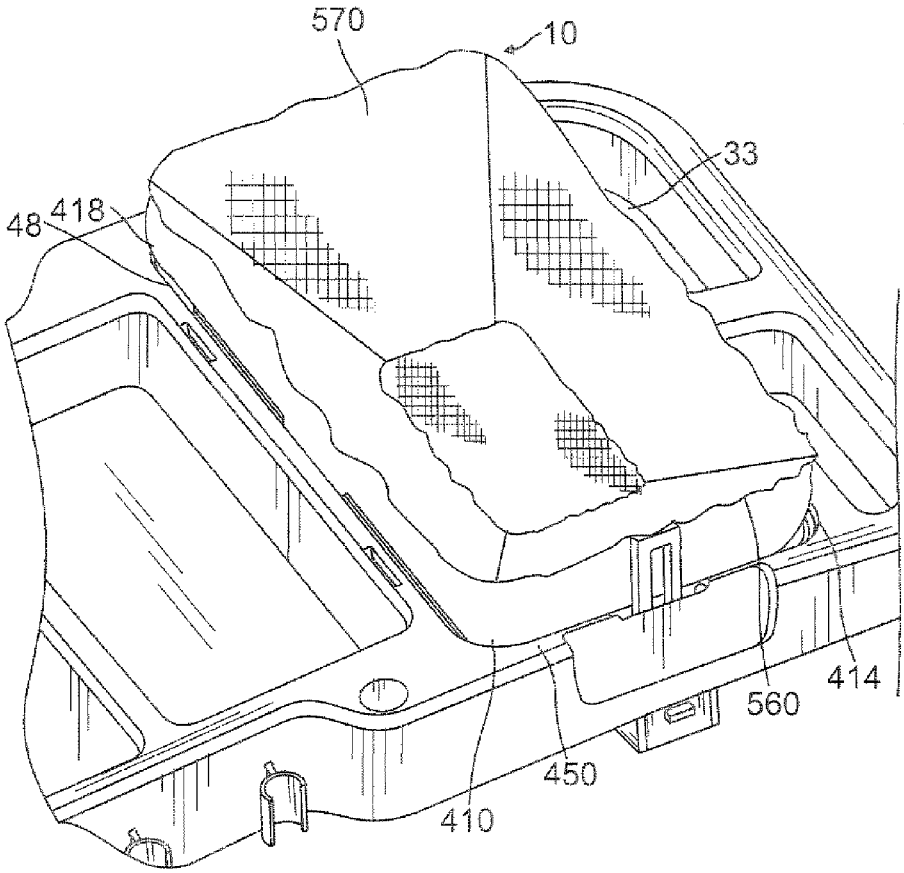
FIG. 5 is top perspective view of the present invention disposable trash bag retaining assembly removed from the janitorial cart to better illustrate the interior components, illustrating the disposable trash bag wrapped over the retaining ring before it is sandwiched between the retaining ring and the interior rim of the trash bag receptacle portion which is illustrated in FIG. 6.
Figure 6:
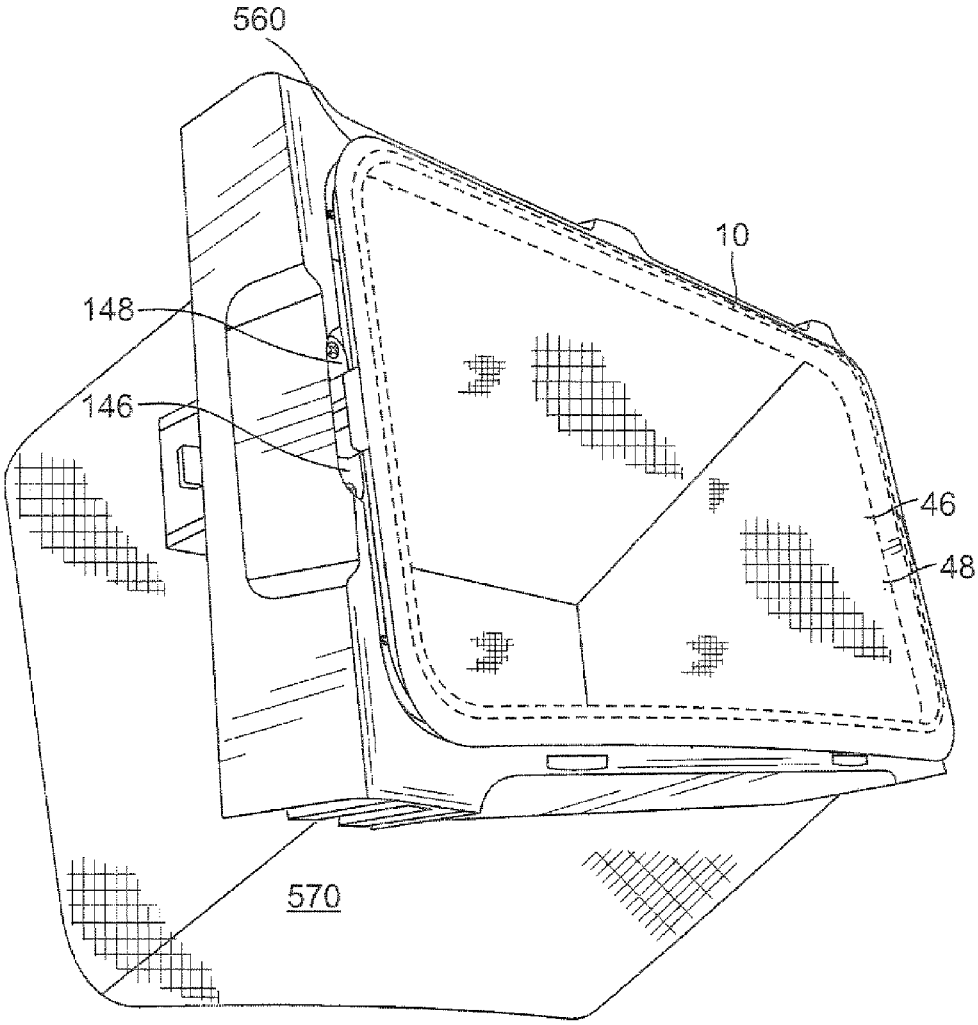
FIG. 6 is a top perspective view of the present invention trash bag retaining assembly removed from the janitorial cart to better illustrate its interior components, illustrating the retaining ring in the activated condition (and shown in dotted lines since it is covered by the disposable trash bag) and retaining a trash bag wrapped over the retaining ring and its open ends entrapped between the retaining ring and the interior circumference of the trash receptacle portion.
Figure 7:
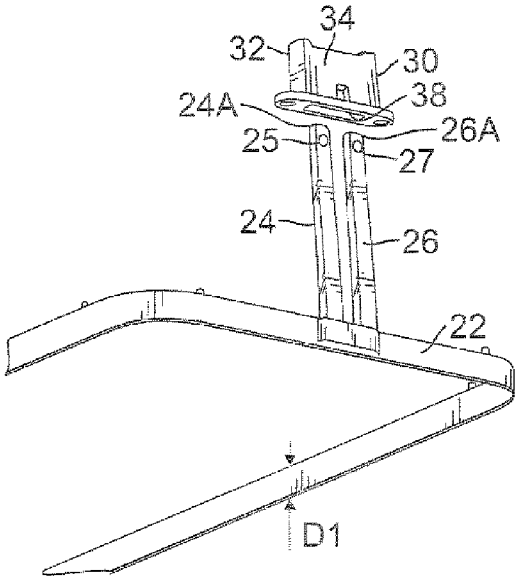
FIG. 7 is partial exploded perspective view illustrating the retaining ring, a first pair of fixed retaining legs affixed to a first widthwise side of the retaining ring and a portion of the first activation mechanism housing away from the retaining legs.
Figure 8:
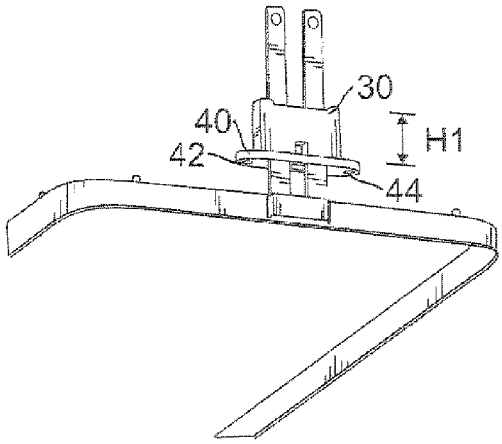
FIG. 8 is a partial exploded perspective view illustrating the retaining ring, a first pair of fixed retaining legs affixed to a first widthwise side of the retaining ring and a portion of the activation mechanism housing slid onto the retaining legs.
Figure 9:
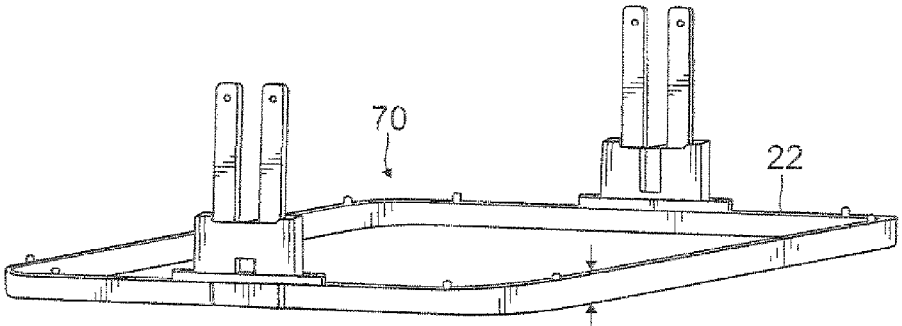
FIG. 9 is a perspective view when viewed from the bottom of the retaining ring with a first pair of retaining legs affixed to a first widthwise end of the retaining ring and a first activation mechanism housing in its operative condition retained on the first pair of retaining legs and a parallel second pair of retaining legs affixed to a second widthwise end of the retaining ring and a second activation mechanism housing in its operative condition retained on the second pair of retaining legs.
Figure 7A:
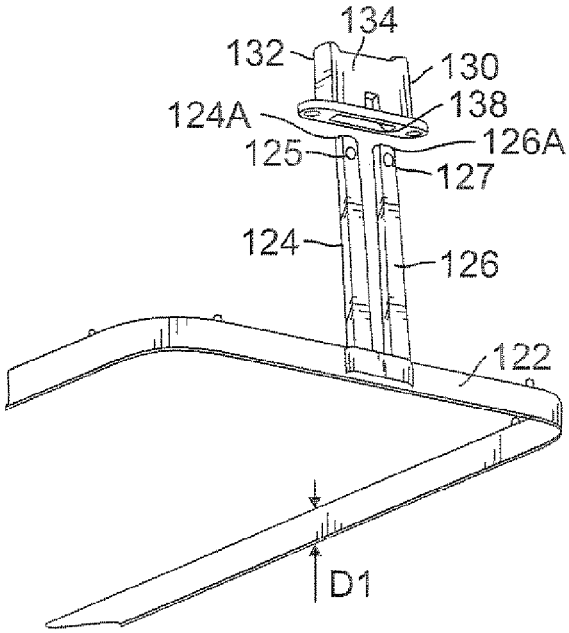
FIG. 7A is a partial exploded perspective view illustrating the retaining ring. a second pair of fixed retaining legs affixed to a second widthwise side of the retaining ring and a portion of the second activation mechanism away from the retaining legs.
Figure 8A:
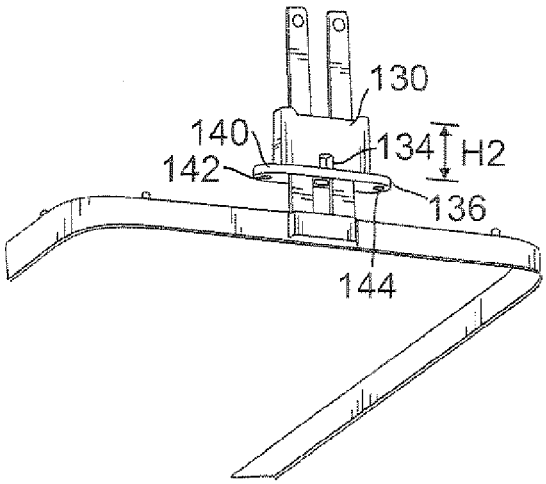
FIG. 8A is a partial exploded perspective view illustrating the retaining ring, a second pair of fixed retaining legs affixed to a second widthwise side of the retaining ring and a portion of the activation mechanism housing slid onto the retaining legs.

FIGS. 5 and 6 illustrate the open ends 560 of the disposable trash bag 560 wrapped around the retaining ring 10 so that the open ends effectively envelope the retaining ring 10 and are pushed to the location between the retaining ring 10 and the upper interior rim 420 so that when the retaining ring 10 is pressed against the upper interior rim 420, the ends 560 of the disposable trash bag 570 are entrapped between the retaining ring 10 and the upper rim 420.

Figure 10:
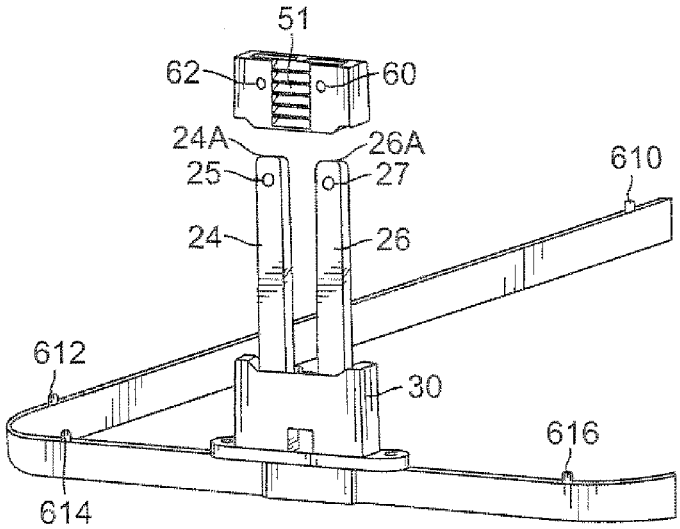
FIG. 10 is partial exploded perspective view illustrating the retaining ring, a first pair of fixed retaining legs affixed to a first widthwise side of the retaining ring, a portion of the first activation mechanism housing in its operative condition, and a portion of the first movable activation mechanism away from the retaining legs.
Figure 11:
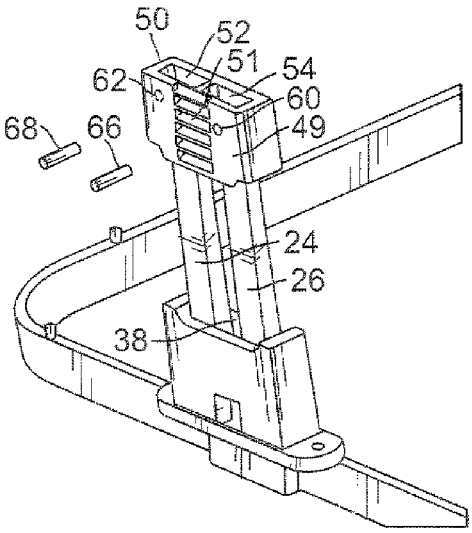
FIG. 11 is a partial exploded perspective view illustrating the retaining ring, a first pair of fixed retaining legs affixed to a first widthwise side of the retaining ring, a portion of the first activation mechanism housing slid onto the retaining legs in its operative condition, and a portion of the first movable activation mechanism slid onto the retaining legs and illustrating a first pair of rivets by which the first movable mechanism is affixed at the bottom of the first pair of retaining legs.
Figure 12:
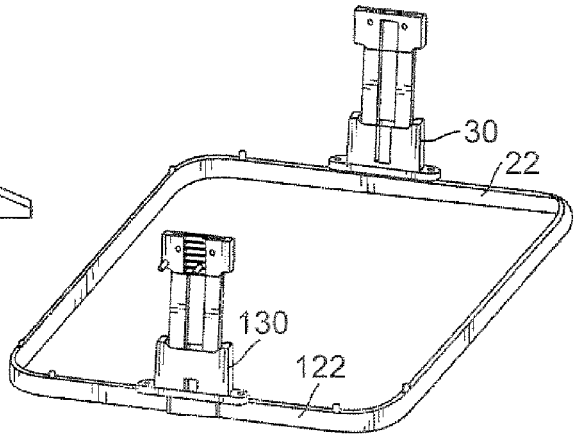
FIG. 12 is a perspective view when viewed from the bottom of the retaining ring with a first pair of retaining legs affixed to a first widthwise end of the retaining ring and a first activation mechanism housing in its operative condition retained on the first pair of retaining legs and the first movable mechanism affixed to the bottom of the first pair of retaining legs by a pair of rivets and a parallel second pair of retaining legs affixed to a second widthwise end of the retaining ring and a second activation mechanism housing in its operative condition retained on the second pair of retaining legs and the movable mechanism affixed to the bottom of the second pair of retaining legs by a pair of rivets.
Figure 10A:
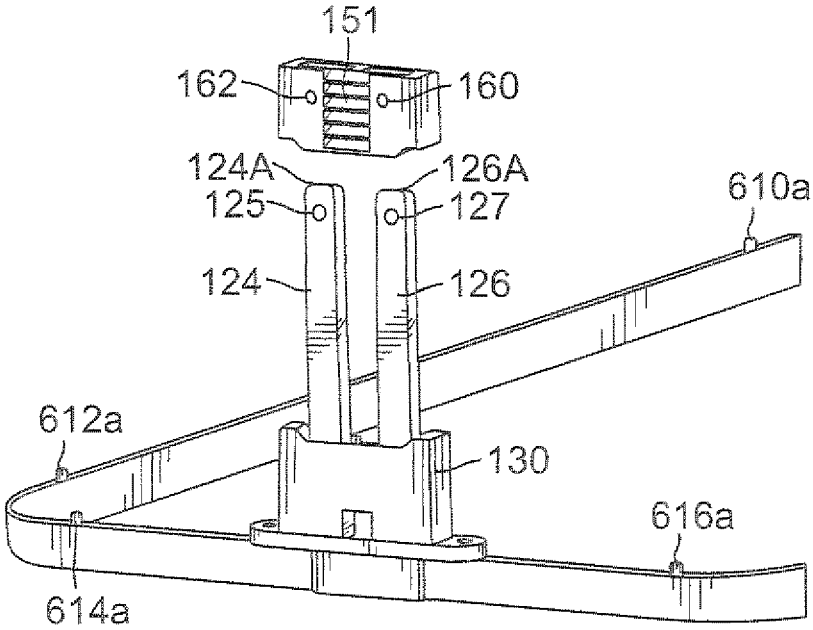
FIG. 10A is partial exploded perspective view illustrating the retaining ring, a second pair of fixed retaining legs affixed to a second widthwise side of the retaining ring, a portion of the second activation mechanism housing in its operative condition, and a portion of the second movable activation mechanism away from the retaining legs.
Figure 11A:
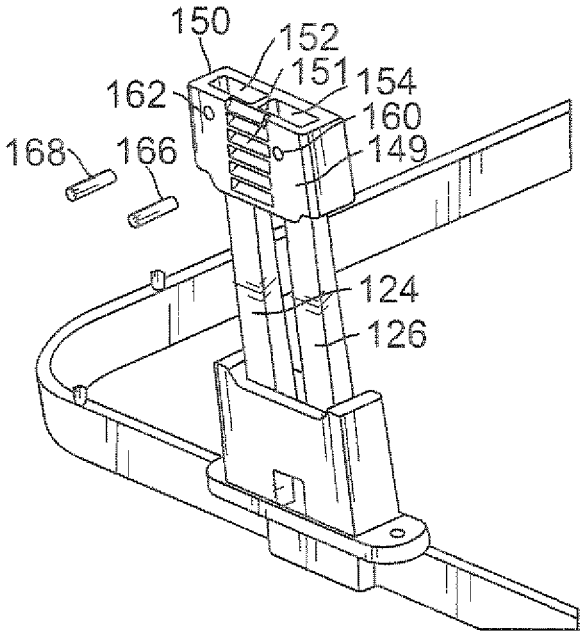
FIG. 11A is a partial exploded perspective view illustrating the retaining ring, a second pair of fixed retaining legs affixed to a second widthwise side of the retaining ring, a portion of the second activation mechanism housing slid onto the retaining legs in its operative condition, and a portion of the second movable activation mechanism slid onto the retaining legs and illustrating a second pair of rivets by which the second movable mechanism is affixed at the bottom the second pair of retaining legs.
Figure 13:
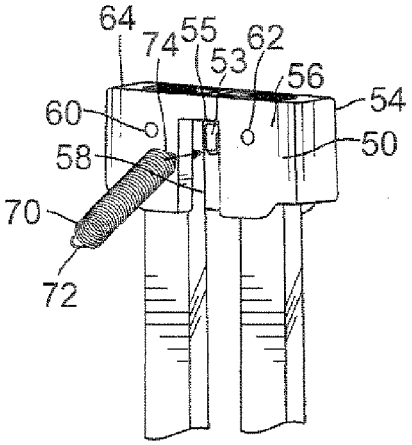
FIG. 13 is a perspective view of a portion of the first movable mechanism and an interior slot retaining a first end of a first return spring.
Figure 14:
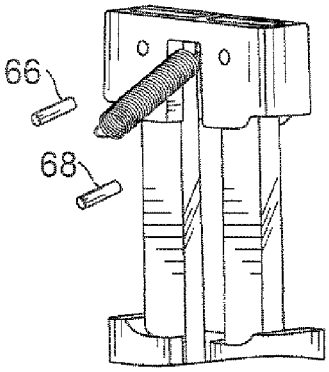
FIG. 14 is a perspective view of a portion of the first movable mechanism and an interior slot retaining a first end of a first return spring, and illustrating a portion of a first activation mechanism housing.
Figure 15:
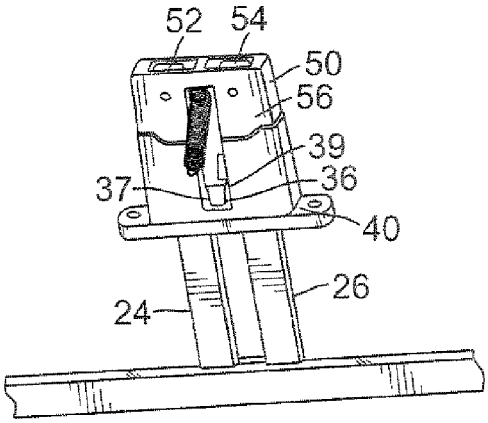
FIG. 15 is a perspective view of a first movable mechanism and an interior slot retaining a first end of a first return spring, and a first mating activation mechanism housing with a slot and mechanism to retain a second end of the return spring, both first movable mechanism and first activation mechanism on a first pair of fixed retaining legs affixed to the retaining ring.
Figure 16:
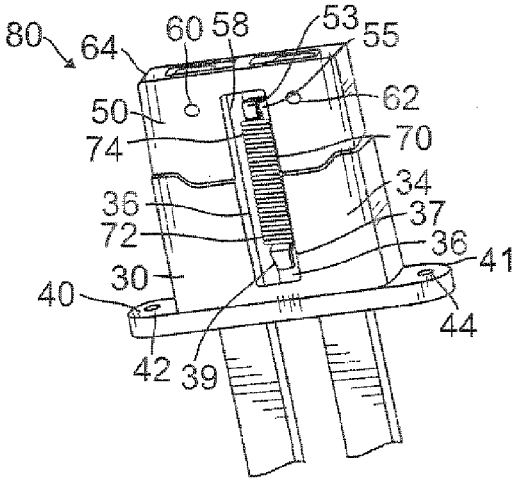
FIG. 16 is a perspective view of a first movable mechanism and an interior slot retaining a first end of a first return spring, and a first mating activation mechanism housing with a slot and mechanism to retain a second end of the first return spring with the second end of the first return spring retained within the slot of the activation mechanism housing, both first movable mechanism and first activation mechanism on a first pair of fixed retaining legs affixed to the retaining ring.
Figure 13A:
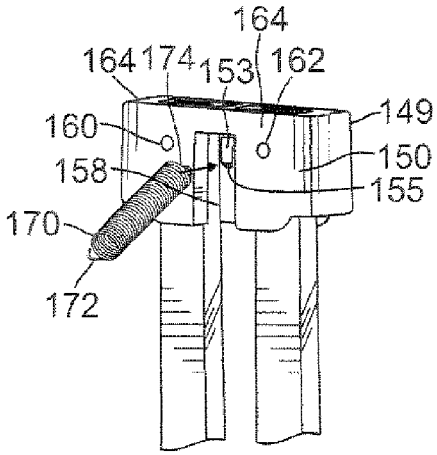
FIG. 13A is a perspective view of a portion of the second movable mechanism and an interior slot retaining a first end of second return spring.
Figure 14A:
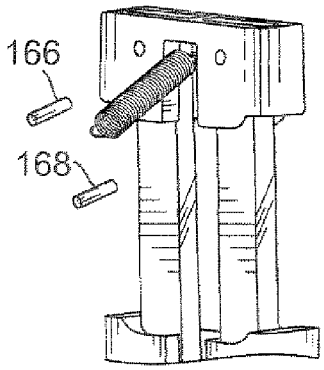
FIG. 14A is a perspective view of a portion of the second movable mechanism and an interior slot retaining a second end of a second return spring and illustrating a portion of a second activation mechanism housing.
Figure 15A:
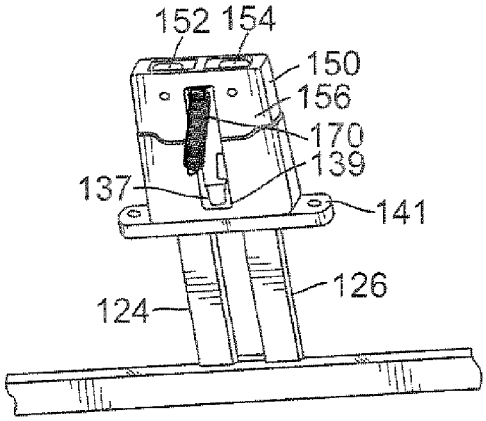
FIG. 15A is a perspective view of a second movable mechanism and an interior slot retaining a first end of a return spring, and a second mating activation mechanism housing with a slot and mechanism to retain a second end of the return spring, both second movable mechanism and second activation mechanism on a second pair of fixed retaining legs affixed to the retaining ring.
Figure 16A:
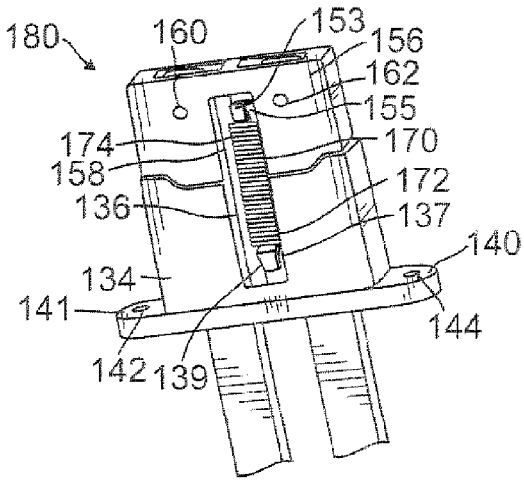
FIG. 16A is a perspective view of a second movable mechanism and an interior slot retaining a first end of a second return spring, and a second mating activation mechanism housing with a slot and mechanism to retain a second end of the second return spring with the second end of the second return spring retained within the slot of the activation mechanism housing, both second movable mechanism and second activation mechanism on a second pair of fixed retaining legs affixed to the retaining ring.

Referring to FIG. 10, the lower portion of the retaining ring 10 contains transverse pins or bumps 610, 612, 614 and 616 Similarly, the opposite section of the retaining ring 10 illustrated in FIG. 10A contains bumps 610A, 612A, 614A, and 616A. Referring to FIGS. 1, 4, 5 and 6, when the retaining ring 10 is pushed into the activated condition so that it is press fit against the open interior ring 420, the pins or bumps 610, 612, 614, 616, 610A, 612A, 614A, and 616A further serve to depress and retain the open ends 60 of the disposable trash bag 570 within the interior rim 420 to more securely retain the disposable trash bag.

Referring to FIGS. 1, 2, 3, 4 and 19, the retaining wire 10 conforms to the shape of the upper interior rim 420 of the top 410 of trash container section 408 which also retains the flexible trash container 400, wherein the upper interior rim 420 includes the first transverse edge 430, the first longitudinal lengthwise side 470, the second transverse edge 450 and the second longitudinal lengthwise side 480 and previously discussed curved connecting sections 412, 414, 416 and 418. First transverse edge 22 of retaining wire 10 conforms to first transverse edge 430, first lengthwise side 23 of retaining wire 10 conforms to first longitudinal lengthwise side 470, second transverse edge 122 of retaining wire 10 conforms to the second transverse edge 450 and second lengthwise side 123 of retaining wire 10 conforms second longitudinal lengthwise side 480. Curved section 12 of retaining wire 10 conforms to curved section 412; curved section 14 of retaining wire 10 conforms to curved section 414, curved section 16 of retaining wire 10 conforms to curved section 416; and curved section 18 of retaining wire 10 conforms to curved section 418.

Figure 3:
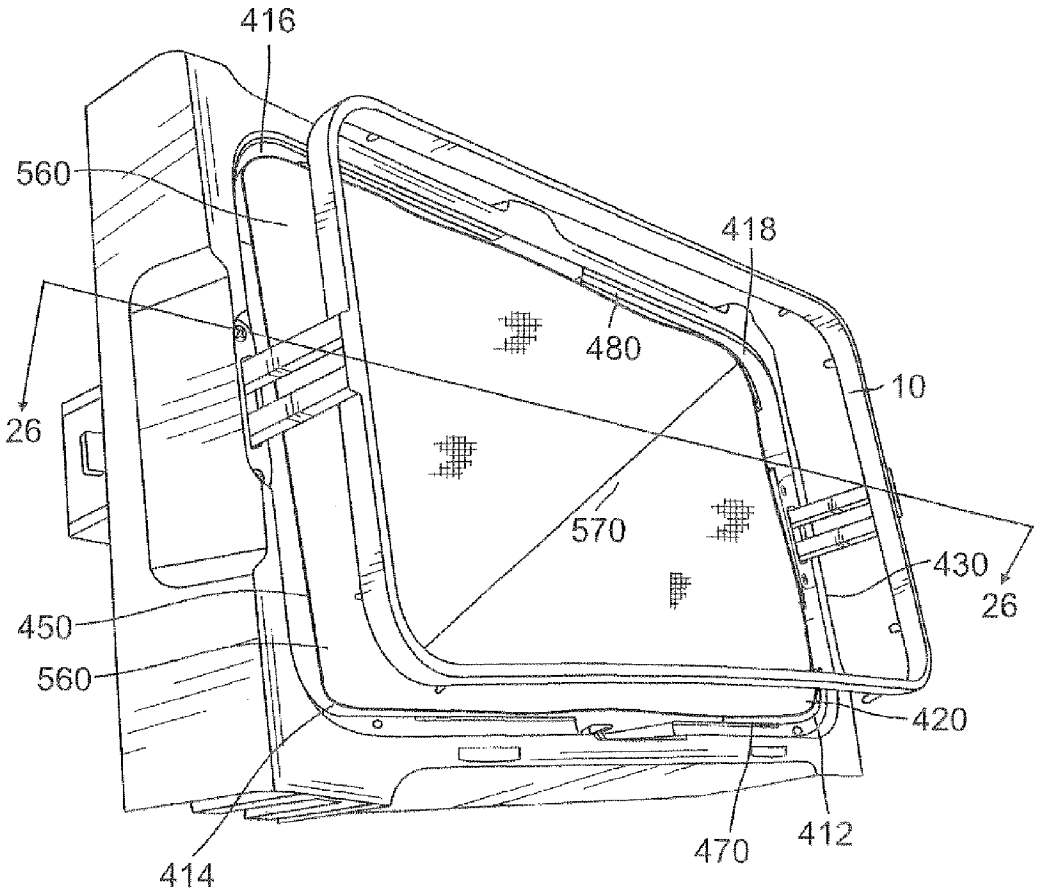
FIG. 3 is a top perspective view of the present invention disposable trash bag retaining assembly removed from the janitorial cart to better illustrate its interior components, illustrating the retaining ring in the opened condition and illustrating the position for a trash bag to be wrapped over the retaining ring and the open ends of a disposable trash bag inserted between the retaining ring and the upper interior circumference of the trash retaining portion.

The retaining wire 10 is therefore press fit retained into the upper interior rim 420. The retaining wire 10 is raised off of the upper interior rim by an upward force on the transverse edges 22 and 122 to overcome the spring retaining force of the springs 70 and 170 so that movable members 50 and 150 slide upwards within respective central chambers 436 and 46 and feet 24, 26, 124 and 126 are partially pulled out of central chambers 436 and 456 so that the retaining wire 10 is above the upper interior rim 420 as illustrated in FIGS. 1 and 3. A trash bag 570 is inserted into the trash bag retaining receptacle 400 of the cart 500 and the ends 560 of the trash bag 570 are wrapped around retaining wire 10 and positioned between retaining wire 10 and upper rim 420 and press it to be retained within rim by force springs as will be described. When the retaining force is released so that the springs 70 and 170 cause the retaining wire 10 to return to its position above the upper rim, thereby releasing the trapped ends 560 of the trash bag 570.

Figure 23:
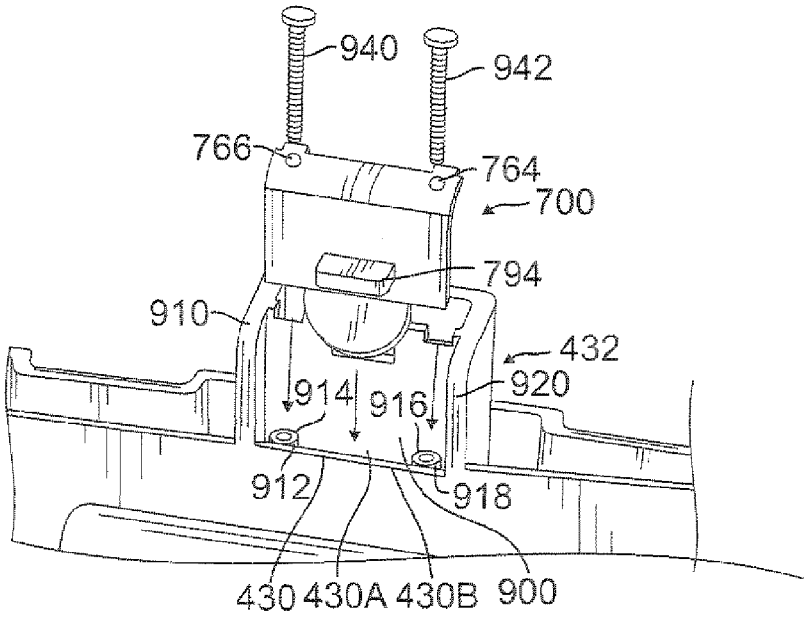
FIG. 23 is a partially exploded view illustrating how the first trigger mechanism of the present invention is inserted into a portion of the first activation assembly receiving housing of the present invention.
Figure 21A:
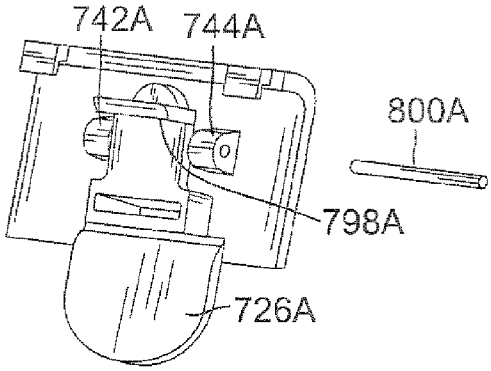
FIG. 21A is a top elevational view of a partially assembled second trigger mechanism of the present invention.
Figure 22A:
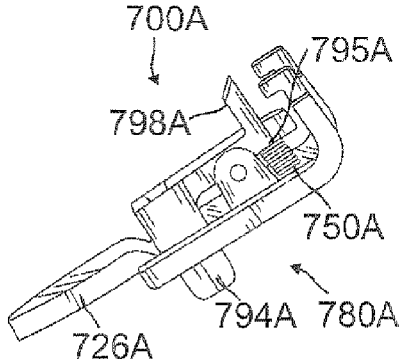
FIG. 22A is a side elevational view of the assembled second trigger mechanism of the present invention.

The final mechanical component is the trigger mechanism 700. Referring to FIGS. 20, 21, 22, 23 and 24, the trigger mechanism includes a plate 710 having a tongue 726 extending from the lower edge 712 of plate 710. Plate 700 has a body 730 having a pair of spaced apart dowel retainers 740 and 744 with a respective central transverse opening 742 and 746 in each respective dowel retainer. Dowel retainer 740 and its transverse opening 742 are parallel to dowel retainer 744 and its transverse opening 746 with the transverse openings 742 and 746 being aligned. A spring retaining hooked base 748 is also affixed to plate 710 and is positioned away from but midway between the dowel retainers 740 and 744. A force spring 750 is force fit retained at a first end 752 to spring retaining hooked base 748. The plate 710 has an upper transverse section 760 affixed to the upper edge 714 of plate 710. Transverse section 760 has a pair of spaced apart openings 762 and 764 which extend through the thickness "T1" of transverse section 760. The trigger mechanism 700 includes a hook member 780 which includes a transverse pushbutton 794 adjacent the lower end 782 of hook member 780, a pair of spaced apart parallel walls 786 and 788 with a transverse opening 790 adjacent wall 786 with opening 788. At the upper end 784 is affixed a transverse hook section 796 with a transverse hook extending from the distal end of the transverse hook section 794. When assembled, the hook member is positioned so that its wall openings 790 is aligned with openings 742 an 746 in dowel retainers 740 and 744 and a dowel 800 extends through all three openings 742, 746 and 790. The second end 754 of force spring 750 is attached to the rear surface 795 of transverse hook section 798. Plate 710 has a transverse opening 716 through which pushbutton 794A extends in a transverse direction Referring to FIG. 23, the wire mounting receiving assembly 432 has a rear section 900 bounded by a pair of longitudinal sidewalls 910 and 920. A first receiving threaded member 912 with a threaded opening 914 is within the rear section 900 and affixed to an interior wall 430A of first transverse edge 430 and adjacent longitudinal sidewall 910 and a parallel spaced apart second receiving threaded member 916 with a threaded opening 918 is within the rear section 900 and affixed to the interior wall 430A and adjacent longitudinal sidewall 920. As illustrated in FIG. 23, the trigger mechanism 700 is inserted into the rear section 900 so that tongue 726 fits between threaded receiving members 912 and 916 and pushbutton 794 rests on surface 430B of first transverse edge 430 (see FIG. 24) and opening 766 is aligned with opening 914 and opening 764 is aligned with opening 918 and a first elongated threaded bolt 940 is threaded through opening 766 and threaded into threaded opening 914 and a second elongated threaded bolt 942 is threaded through opening 764 and threaded into opening 918 so that the trigger mechanism is affixed into rear section 900 wire mounting receiving assembly 432.

Figure 23A:
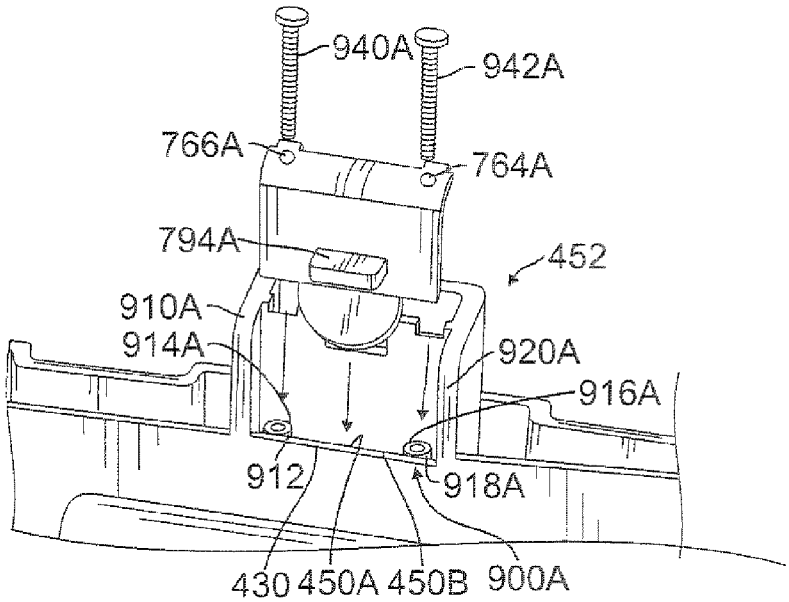
FIG. 23A is a partially exploded view illustrating how the second trigger mechanism of the present invention is inserted into a portion of the second activation assembly receiving housing of the present invention.
Figure 24:
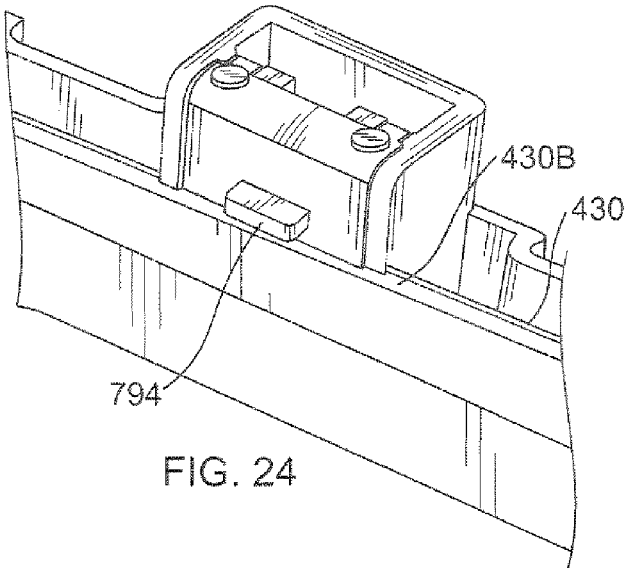
FIG. 24 is an exterior perspective view of the first trigger mechanism of the present invention inserted into and retained in the first activation assembly receiving housing.
Figure 25:
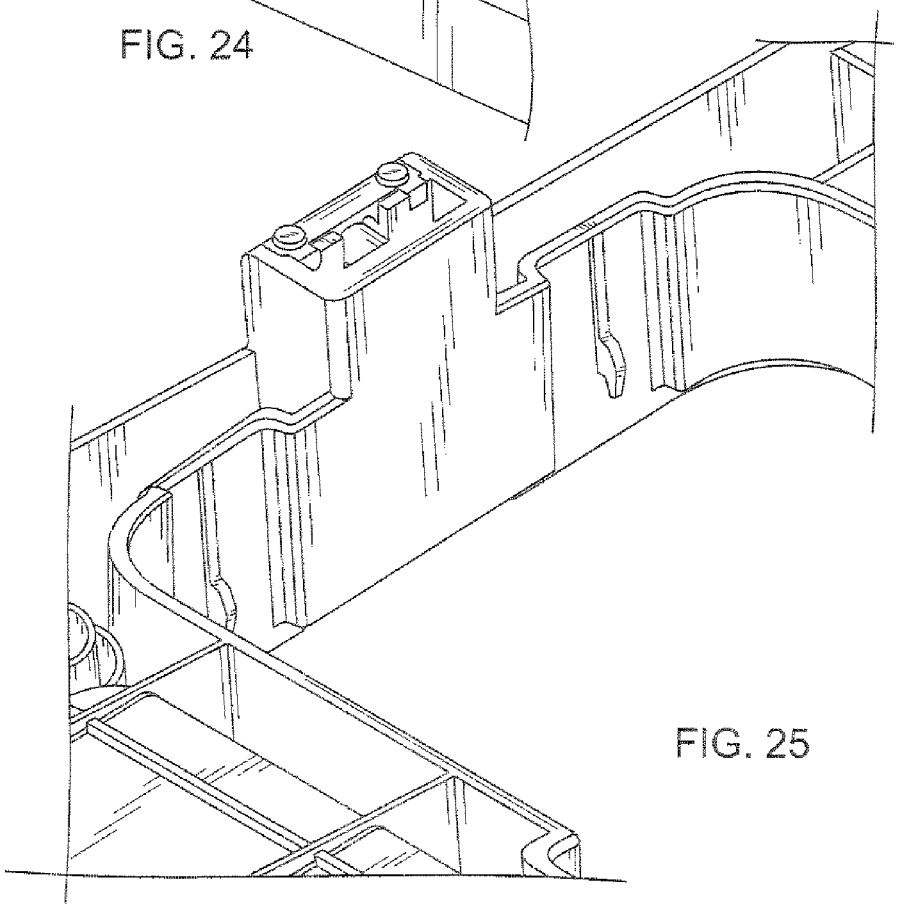
FIG. 25 is an interior perspective view of the first trigger mechanism of the present invention inserted into and retained in the first activation assembly receiving housing.
Figure 24A:
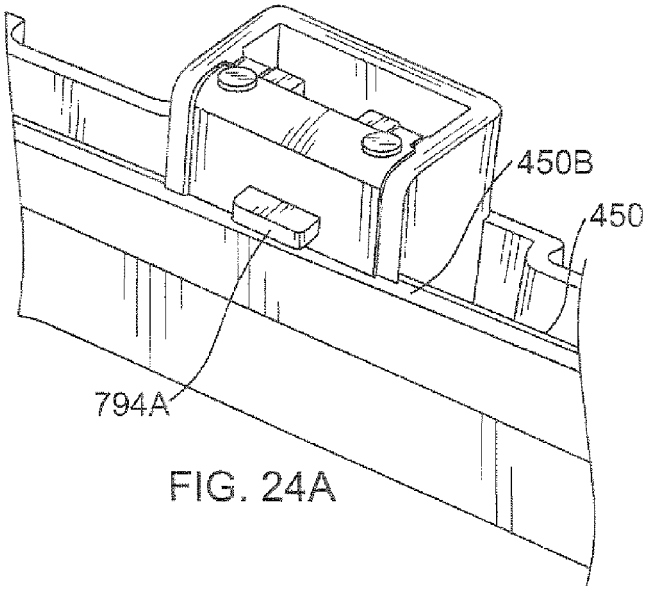
FIG. 24A is an exterior perspective view of the second trigger mechanism of the present invention inserted into and retained in the second activation assembly receiving housing.
Figure 25A:
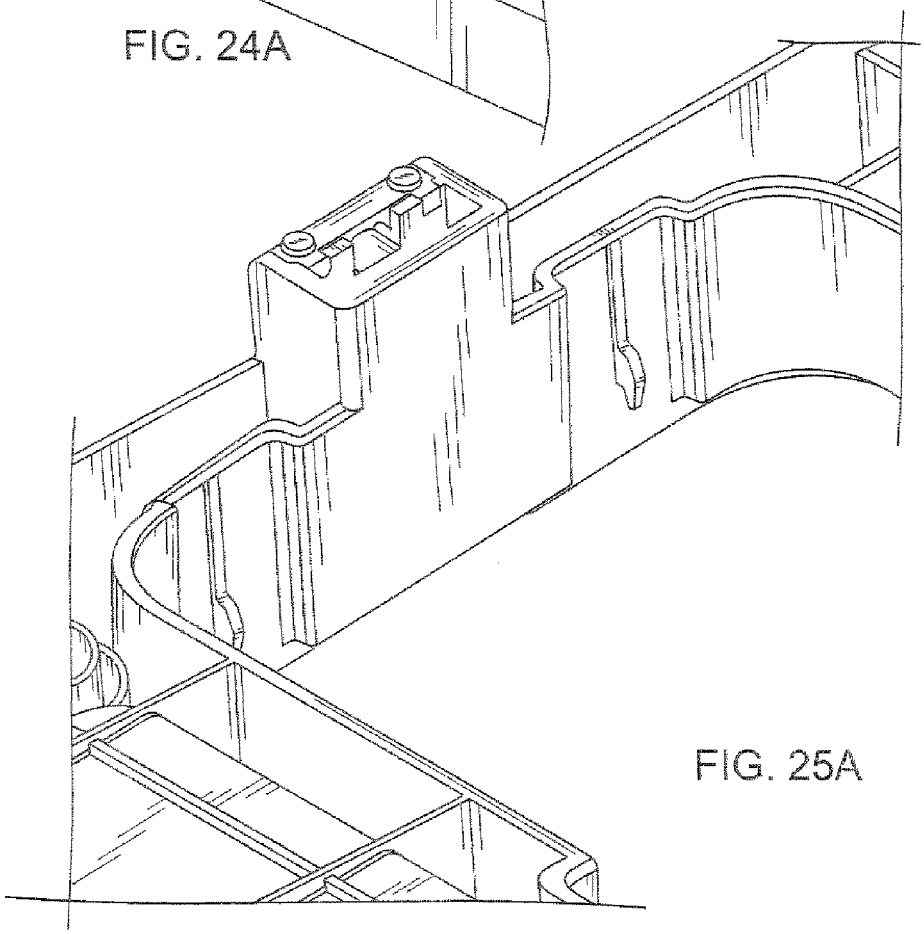
FIG. 25A is an interior perspective view of the second trigger mechanism of the present invention inserted into and retained in the second activation assembly receiving housing.

The opposite side also has a trigger mechanism 700A. Referring to FIGS. 20A, 21A, 22A, 23A, 24A and 25A, the trigger mechanism includes a plate 710A having a tongue 726A extending from the lower edge 712A of plate 710A. Plate 700A has a body 730A having a pair of spaced apart dowel retainers 740A and 744A with a respective central transverse opening 742A and 746A in each respective dowel retainer. Dowel retainer 740A and its transverse opening 742A are parallel to dowel retainer 744A and its transverse opening 746A with the transverse openings 742A and 746A being aligned. A spring retaining hooked base 748A is also affixed to plate 710A and is positioned away from but midway between the dowel retainers 740A and 744A. A force spring 750A is retained at a first end 752A to spring retaining hooked base 748A. The plate 710A has an upper transverse section 760A affixed to the upper edge 714A of plate 710A. Transverse section 760A has a pair of spaced apart openings 762A and 764A which extend through the thickness "T1" of transverse section 760A. The trigger mechanism 700A includes a hook member 798A which includes a transverse pushbutton 794A adjacent the lower end 782A of hook member 780A, a pair of spaced apart parallel walls 786A and 790A with a transverse opening 788A in wall 786A and a transverse opening 782A in wall 788A, with an opening 790A extending therethrough. At the upper end 784A is affixed a transverse hook section 796A with a transverse hook 798A extending from the distal end of the transverse hook section 794A. When assembled, the hook member is positioned so that its wall opening 790A is aligned with openings 742A an 746A in dowel retainers 740A and 744A and a dowel 800A extends through all openings 742A, 746A and 790A. The second end 754A of force spring 750A is attached to the rear surface 795A of transverse hook section 796A. Plate 710A has a transverse opening 716A through which pushbutton 794A extends in a transverse direction The wire mounting receiving assembly 452 has a rear section 900A bounded by a pair of longitudinal sidewalls 910A and 920A. A first receiving threaded member 912A with a threaded opening 914A is within the rear section 900A and affixed to an interior wall 450A of second transverse edge 450 and adjacent longitudinal sidewall 910A and a parallel spaced apart second receiving threaded member 916A with a threaded opening 918A is within the rear section 900A and affixed to the interior wall 450A and adjacent longitudinal sidewall 920A. As illustrated in FIG. 23A, the trigger mechanism 700A is inserted into the rear section 900A so that 726A fits between (see FIG. 18) threaded receiving members 912A and 916A and pushbutton 794A rests on surface 450B of second transverse edge 450 and opening 766A is aligned with opening 914A and opening 766A is aligned with opening 914A and a first elongated threaded bolt 940A is threaded through opening 766A and threaded into threaded opening 914A and a second elongated threaded bolt 942A is threaded through opening 764A and threaded into opening 918A so that the trigger mechanism is affixed interior section 900A wire mounting receiving assembly 432A.

Figure 17:
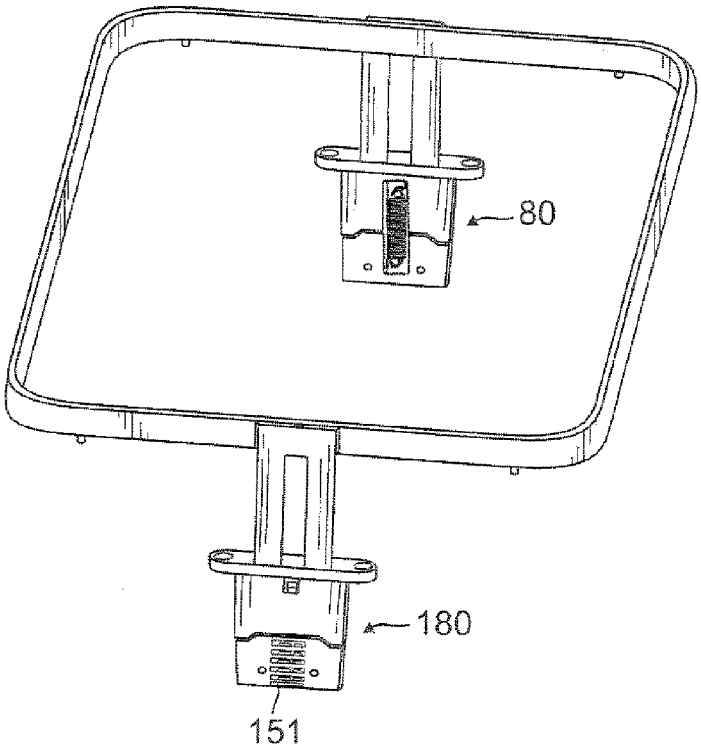
FIG. 17 is a top perspective view of the retaining ring with a first activator mechanism assembly including a first pair of retaining legs with a first movable member affixed to the bottom the first pair of retaining legs and a first activation mechanism housing retained on the retaining legs between the retaining ring and the first movable member and a parallel second activator mechanism assembly including a second pair of retaining legs with a second movable member affixed to the bottom the second pair of retaining legs and a second activation mechanism housing retained on the retaining legs between the retaining ring and the second movable member.

Referring to FIGS. 17 and 18, there is illustrated the first wire mounting assembly 80 affixed to the first widthwise transverse edge 22 of retaining wire 10 and the second wire mounting assembly 180 affixed to the second transverse edge 122 of retaining wire 10 before insertions into the respective wire receiving assemblies 432 and 452 of the upper interior rim 420 of trash container 410.

Referring back to FIGS. 1, 2 and 26, retaining wire 10 is locked in its position against the interior rim 420 of trash bag retainer 410 by the spring force of tension spring 70 retaining first movable block 50 to first mounting block 30 which is affixed to the first transverse edge of retaining ring 10 and by force spring 170 retaining second movable block 150 to second mounting block 130 which is affixed to the second transverse edge of the retaining wire 10.

Figure 26:
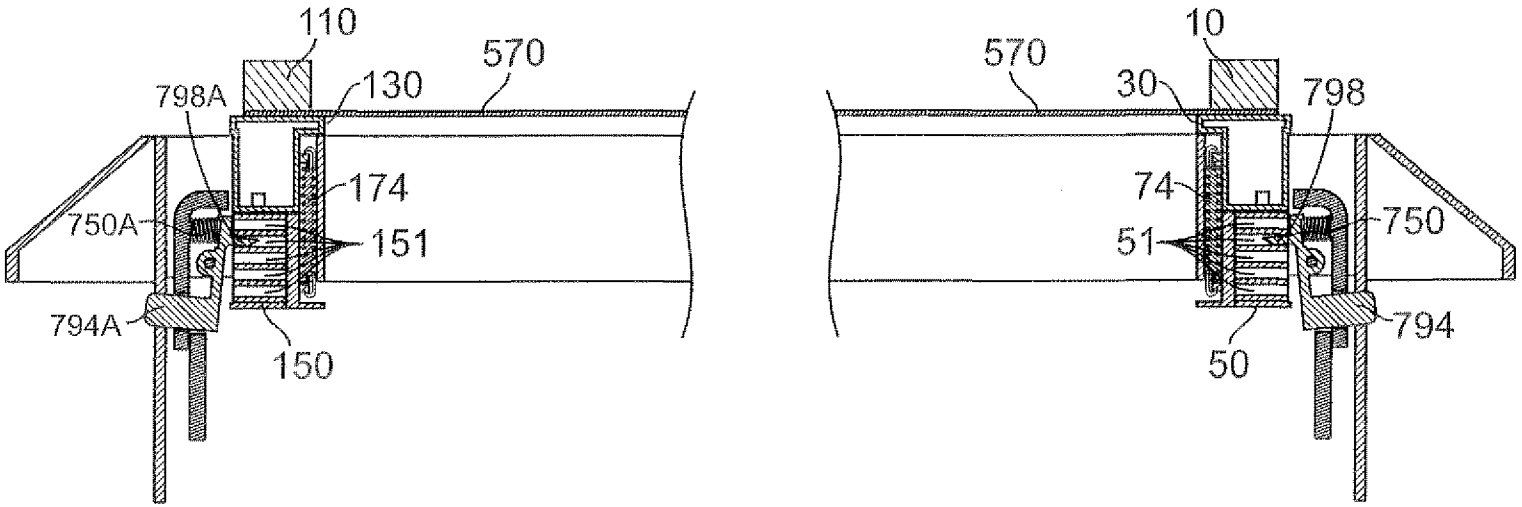
FIG. 26 is a cross-sectional view taken along line 26-26 of FIG. 3.

A downward force on retaining ring 10 causes the spring force of spring 750 to push tooth 798 of first locking assembly 700 against the ratcheted teeth 51 of the first moving block 50 and the spring force of spring 750A to push tooth 798A of second locking assembly 700A against ratcheted teeth 151 of second moving block 150 to thereby lock the retaining ring 10 in its engaged position within interior rim 420 as illustrated in FIGS. 1, 4 and 26. As previously described, the open ends 560 of a disposable trash bag 570 are placed between the interior rim 420 and the retaining ring 10 so that the disposable trash bag 570 is trapped between the upper rim 420 and the retaining ring.

When pushbuttons 794 and 794A are pushed inwardly, then this causes a release of a respective tooth 798 and 798A from a respective ratcheted tooth member 51 and 151 and the spring forces 70 and 170 cause the movable blocks 50 and 150 to come together with their respective mounting blocks 30 and 130 and release the engagement force so that the feet 24, 26, 124, 126 and assemblies 80 and 180 spring upwardly causing retaining ring 10 to spring upwardly away from interior rim 420 thereby releasing the entrapped disposable trash bag 570. The filled trash bag 570 can be discarded and replaced with a new empty disposable trash bag 570.

Through use of the present invention, the trash bag 570 is very securely retained against the upper interior rim 420 of the top 410 of the trash container 408 portion of a janitorial cart 500. The dual spring action 70 and 170 securely causes the retaining ring 10 to be firmly pressed against the upper interior of the trash container 400 so that a trash bag 570 will not come loose even after a lot of trash is placed in the trash bag. The use of the wire mounting assemblies 80 and 180 with the secure first and second mounting blocks 30 and 130 and movable members 50 and 150 retained within centrally disposed receiving openings 438 and 458 make for a very secure retention mechanism. The retaining wire 10 is firmly retained against the upper rim 420 to secure and retain the ends 520 of the trash bag between the retaining wire 10 and the upper rim 420. The pushbutton release mechanism enables the retaining ring to quickly spring away from the interior rim 420 so that the trash bag 570 can be quickly replaced.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An apparatus to retain a disposable trash bag onto a top portion of a trash bag receptacle portion of a janitorial cart, comprising:

a. the top portion of the trash bag receptacle portion includes an upper interior rim which encircles an interior circumference of the trash bag receptacle portion, the upper interior rim including a first transverse edge, a parallel oppositely disposed second transverse edge, a first longitudinal lengthwise side and a parallel second longitudinal lengthwise side, the first transverse edge and the first longitudinal lengthwise side connected by a first curved section, the first longitudinal lengthwise side and the second transverse edge connected by a second curved section, the second transverse edge and the second longitudinal lengthwise side connected by a third curved section, and the second longitudinal lengthwise side and a first widthwise edge connected by a fourth curved sections, the upper interior rim formed as one continuous strip composed of widthwise edges, longitudinal lengthwise sides and curved sections;

b. the first transverse edge includes a first centrally disposed wire mounting assembly receiving member which includes a body having a central chamber with a first receiving opening to one side of the central chamber and a second receiving opening to an opposite side of the central chamber;

c. the second transverse edge includes a second centrally disposed wire mounting assembly receiving member which includes a body having a central chamber with a first receiving opening to one side of the central chamber and a second receiving opening to an opposite side of the central chamber, the first wire mounting receiving assembly and the second wire mounting receiving assembly are parallel to each other and are respectively affixed inwardly from a respective interior side of a respective transverse edge, both extending into a central opening of the upper interior rim;

d. a one-piece generally rectangular retaining wire having curved corners which interconnect parallel oppositely disposed widthwise edges and parallel oppositely disposed lengthwise sides which conform to the shape of the top interior rim so that the retaining wire can be pressed into the top interior rim with a top of a disposable trash bag trapped between the upper interior rim and the generally rectangular retaining wire;

e. the retaining wire having a given thickness, affixed to a first transverse edge of the retaining wire are a first pair of spaced apart feet, each foot having an opening adjacent a distal end, a first mounting block having a smooth side and a notched side with a central notch which contains a central hook member with an opening which faces a distal end of the first mounting block, the first mounting block is placed onto the first pair of spaced apart feet through a longitudinal channel which extends for a given height of the mounting block, the first mounting block having a transverse top section having a pair of spaced apart openings;

f. a first moving block having a pair of spaced apart channels which are respectively aligned with the first pair of spaced apart feet so that the first moving block has its channels respectively placed onto a respective one of the first pair of spaced apart feet so that the moving block can slide down the first pair of spaced apart feet, the first moving block having a ratcheted side and a notched side with a central notch, the first moving block having a first opening adjacent it distal end and a parallel spaced apart second opening, the central notch contains a hook with an opening which faces its distal end of the first moving block, the openings are respectively aligned with openings in the feet and the first moving block is affixed to the feet by a first affixing means, the notched side of the first mounting block and the notched side of first moving block face inwardly toward a central opening in the generally rectangular retaining wire so that their respective notches are aligned, a first tension spring has a hooked first end which is retained into the opening of the central hook member of the first mounting block and a second hooked end which is retained into the opening of the central hook member of the first moving bock so that the first tension spring movably retains the first mounting block to the first moving block, the combined first mounting block and the first moving block comprising a first wire mounting assembly, the central portion of the smooth side of the first moving block having a multiplicity of ratchet teeth which face in the direction of the first mounting block;

g. the retaining wire having a given thickness, affixed to a second transverse edge of the retaining wire are a second pair of spaced apart feet, each foot having an opening adjacent a distal end, a second mounting block having a smooth side and a notched side with a central notch which contains a central hook member with an opening which faces a distal end of the second mounting block, the second mounting block is placed onto the second pair of spaced apart feet through a longitudinal channel which extends for a given height of the mounting block, the second mounting block having a transverse top section having a pair of spaced apart openings;

h. a second moving block having a pair of spaced apart channels which are respectively aligned with the second pair of spaced apart feet so that the second moving block has its channels respectively placed onto a respective one of the second pair of feet so that the moving block can slide down the second pair of feet, the second moving block having a ratcheted side and a notched side with a central notch, the second moving block having a second opening adjacent its distal end and a parallel spaced apart second opening, the central notch contains a hook with an opening which faces the distal end of the second moving block, the openings are respectively aligned with openings in the feet and the second moving block is affixed to the feet by a second affixing means, the notched side of the second mounting block and the notched side of the second moving block face inwardly toward a central opening in the generally rectangular retaining wire so that their respective notches are aligned, a second tension spring has a hooked first end which is retained into the opening of the central hook member of the second mounting block and a second hooked end which is retained into the opening of the hook member of the second moving block so that the second tension spring movably retains the second mounting block to the second moving block, the combined second mounting block and the second moving block comprising a second wire mounting assembly, the central portion of the smooth side of the second moving block having a multiplicity of ratchet teeth which face in the direction of the second mounting block, the first wire mounting assembly parallel to the second wire mounting assembly;

i. the first mounting block and the first moving block are inserted into the central chamber of first centrally disposed wire receiving member and affixed thereto by aligning the openings of the first mounting block with respective receiving openings of the first centrally disposed wire receiving member and having respective fixing screws extend through the respective aligned openings, the second mounting block and the second moving block are inserted into the central chamber of the second centrally disposed wire receiving member and affixed thereto by aligning the openings of the second mounting block with respective receiving openings of the second centrally disposed wire receiving member and having respective fixing screws extending through the respective aligned openings, as a result, the first mounting block is affixed within a central chamber, its first transverse section is affixed to the body and the first moving block and the feet are movably retained within the central chamber of the first centrally disposed wire mounting assembly receiving member, and, as a result, the second mounting block is affixed within a central chamber, its second transverse section is affixed to the body and the second moving block and the feet are movably retained within central chamber of the second centrally disposed wire mounting assembly receiving member;

j. the retaining wire is press fit retained into the upper interior rim, the retaining wire is raised off of the upper interior rim by an upward force on the transverse edges to overcome spring retaining forces of springs so that the first and second movable members slide upwards within respective central chambers and are partially pulled out of the central chambers so that the retaining wire is above the upper interior rim, open ends of a trash bag is wrapped around the retaining wire and positioned between the retaining wire and upper interior rim when a retaining force is released so that the springs cause the retaining wire to return to its position within the upper rim, thereby trapping the ends of the trash bag between the upper interior rim of the cart and the retaining wire so that the trash bag is firmly retained;

k. a first and second trigger mechanism each including a plate having a tongue extending from a lower edge of the plate, the plate having a body having a pair of spaced apart parallel dowel retainers with a respective central transverse opening in each respective dowel retainer, a spring retaining hooked base is also affixed to the plate and is positioned away from but midway between the dowel retainers, a force spring is retained at a first end to the spring retaining hooked base, and the plate has an upper transverse section affixed to the upper edge of the plate, the transverse section has a pair of spaced apart openings which extend through the thickness of the transverse section, the first and second trigger mechanisms each include a hook member which includes a transverse pushbutton adjacent the lower end of the hook member, a pair of spaced apart parallel walls with a transverse opening adjacent the pair of spaced apart walls, at the upper end is affixed a transverse hook section with a transverse hook extending from the distal end of the transverse hook section, when assembled, the hook member is positioned so that its wall openings is aligned with openings in dowel retainers and a dowel extends through all four openings, the second end of the force spring is attached to the rear surface of transverse hook section, the plate has a transverse opening through which the pushbutton extends in a transverse direction;

l. each wire mounting receiving assembly having a rear section bounded by a pair of longitudinal sidewalls, a first receiving threaded member with a threaded opening is within the rear section and affixed to an interior wall of first transverse edge and adjacent the longitudinal sidewall and a parallel spaced apart second receiving threaded member with a threaded opening is within the rear section and affixed to the interior wall and adjacent to the longitudinal sidewall, a respective trigger mechanism is inserted into the rear section of a respective wire receiving assembly so that its tongue fits between threaded receiving members and a pushbutton respectively rests on the surface of a first or second transverse edge and the openings in the transverse edge are aligned with respective openings in the receiving members and respective first elongated threaded bolts are threaded through the openings so that a respective trigger mechanism is affixed into the rear section of a respective wire mounting receiving assembly; and m. the spring force of a respective spring pushes a tooth of a respective first or second locking assembly against the ratcheted teeth of an adjacent moving block to thereby lock the retaining wire in an elevated position so that the open ends of a disposable trash bag are placed between the interior rim and the retaining ring, and a downward force on the retaining wire causes the locking mechanism to be engaged with a ratcheted tooth to retain the ring within the upper interior rim and entrap the trash bag, and then the pushbuttons are pushed inwardly to release a respective tooth from a respective ratcheted tooth member and the spring forces cause the movable blocks to come together with their respective mounting blocks and force the retaining wire away from the interior rim, thereby releasing the entrapped open ends of the disposable trash bag;

n. whereby through use of the present invention, the disposable trash bag is very securely retained against the upper interior rim of the top of the trash container portion of a janitorial cart, the dual spring action securely causes the retaining wire to be firmly pressed against the upper interior of the trash container so that a trash bag will not come loose even after a lot of trash is placed in the trash bag, the use of the wire mounting assemblies with the secure first and second mounting blocks and movable members retained within centrally disposed receiving openings make for a very secure retention mechanism, the retaining wire is firmly retained against the upper rim to secure and retain the ends of the trash bag between the retaining wire and the upper rim, and the pushbutton release mechanism enables the retaining wire to quickly spring away from the interior rim to release the trash bag.

2. An apparatus to retain a disposable trash bag onto a top portion of a trash bag receptacle portion of a janitorial cart, comprising:

a. the top portion of the trash bag receptacle portion includes an upper interior rim which encircles an interior circumference of the trash bag receptacle portion, the upper interior rim including at least a first transverse edge and a parallel oppositely disposed second transverse edge, the interior rim having a given shape;

b. the first transverse edge includes a first centrally disposed wire mounting assembly receiving member which includes a body having a central chamber with a first receiving opening to one side of the central chamber and a second receiving opening to an opposite side of the central chamber;

c. the second transverse edge includes a second centrally disposed wire mounting assembly receiving member which includes a body having a central chamber with a first receiving opening to one side of the central chamber and a second receiving opening to an opposite side of the central chamber, the first wire mounting receiving assembly and the second wire mounting receiving assembly are parallel to each other and are respectively affixed inwardly from a respective interior side of a respective transverse edge, both extending into a central opening of the upper interior rim;

d. a one-piece generally rectangular retaining wire having at least a first transverse edge and a parallel oppositely disposed second transverse edge, the shape of the retaining wire conforming to the shape of the upper interior rim;

e. affixed to a first transverse edge of the retaining wire is a first retaining wire mounting assembly including a pair of spaced apart feet attached to the retaining wire and extending transversely to the retaining wire and including a mounting block retained on the pair of spaced apart feet and affixed to the retaining wire and a first moving block affixed to the distal ends of the feet and functioning as a stop block and a second retaining wire mounting assembly including a pair of spaced apart feet attached to the retaining wire and extending transversely to the retaining wire and including a second mounting block retained on the second pair of feet and affixed to the retaining wire and a second moving block affixed to the distal end of the second pair of spaced apart feet and functioning as a stop block, the first mounting block and the first moving block having conforming slots retaining a first force spring which causes the first mounting block and the first moving block to be retained against one another, the second mounting block and the second moving block having conforming slots which retain a second force spring which causes the second mounting block and the second moving block to be retained against one another, the first retaining wire mounting assembly affixed inside the first receiving opening of the first centrally disposed wire mounting receiving assembly and the second retaining wire mounting assembly affixed inside the first receiving opening of the second centrally disposed wire mounting receiving assembly;

f. the first moving block having tooth engaging members on a side opposite the first force spring and a first locking member having an engaging tooth, the first locking member retained in the second receiving opening of the first centrally disposed wire mounting receiving assembly, the second moving block having a tooth engaging member on a side opposite the second force spring and a second locking member retained in the second receiving opening of the second centrally disposed wire mounting receiving assembly, spring means to cause each respective tooth of a locking member to engage a tooth engaging member of a respective moving block; and g. the spring force of a respective spring pushes a tooth of a respective first or second locking assembly against the ratcheted teeth of an adjacent moving block to thereby lock the retaining wire in an elevated position so that the open ends of a disposable trash bag are placed between the interior rim and the retaining, wire, and a downward force on the retaining wire causes the locking mechanism to be engaged with a ratcheted tooth to retain the ring within the upper interior rim and entrap the trash bag, and then respective pushbuttons are pushed inwardly to release a respective tooth from a respective ratcheted tooth member and the spring forces cause the movable blocks to come together with their respective mounting blocks and force the retaining wire away from the interior rim, thereby releasing the entrapped the open ends of the disposable trash bag.

3. An apparatus to retain a disposable trash bag onto a top portion of a trash bag receptacle portion of a janitorial cart, comprising:

a. the top portion of the trash bag receptacle portion includes an upper interior rim which encircles an interior circumference of the trash bag receptacle portion, the upper interior rim including at least a first transverse edge and a parallel oppositely disposed second transverse edge, the interior rim having a given shape;

b. the first transverse edge includes a first centrally disposed wire mounting assembly receiving member which includes a body having a central chamber with a first receiving opening to one side of the central chamber and a second receiving opening to an opposite side of the central chamber;

c. the second transverse edge includes a second centrally disposed wire mounting assembly receiving member which includes a body having a central chamber with a first receiving opening to one side of the central chamber and a second receiving opening to an opposite side of the central chamber, the first wire mounting receiving assembly and the second wire mounting receiving assembly are parallel to each other and are respectively affixed inwardly from a respective interior side of a respective transverse edge, both extending into a central opening of the upper interior rim;

d. a one-piece generally rectangular retaining wire having at least a first transverse edge and a parallel oppositely disposed second transverse edge, the shape of the retaining wire conforming to the shape of the upper interior rim;

e. affixed to a first transverse edge of the retaining wire is a first retaining wire return assembly and affixed to the second transverse edge is a second retaining wire return assembly, each assembly having a return force spring and teeth engaging members, the first retaining wire return assembly affixed inside the first receiving opening of the first centrally disposed wire mounting receiving assembly and the second retaining wire return assembly affixed inside the first receiving opening of the second centrally disposed wire mounting receiving assembly;

f. a first locking member having an engaging tooth which engages a tooth engaging member of the first retaining wire return assembly, the first locking member retained in the second receiving opening of the first centrally disposed wire mounting receiving assembly, and a second locking member having an engaging tooth which engages a tooth engaging member of the second retaining wire return assembly, the second locking member retained in the second receiving opening of the second centrally disposed wire mounting receiving assembly; and g. the retaining wire is press fit retained into the upper interior rim by the force of the engaged locking teeth overcoming the first and second force springs causing their respective mounting and moving blocks to be retained against one another, a pushbutton release mechanism releases the locking force and causes the retaining wire to be elevated above the upper interior rim until a locking tooth from a first and second respective locking members engages a receiving tooth on a respective moving member to lock the retaining wire in an elevated position above the upper interior rim, and after the ends of a disposable trash bag is inserted between the retaining wire and the upper interior surface, a downward force on the retaining wire pushes the retaining wire return assemblies back into their respective wire mounting receiving assembly and the locking tooth engagement retains the retaining wire against the interior rim to entrap the disposable garbage bag, a release mechanism causes each locking tooth to be released from its engagement with an engaging tooth and the force of the two force springs causes the movable blocks to come together with their respective mounting blocks and force the retaining wire away from the interior rim, thereby releasing the entrapped the open ends of the disposable trash bag.

4. An apparatus to retain a disposable trash bag onto a top portion of a trash bag receptacle portion of a janitorial cart, comprising:

a. the top portion of the trash bag receptacle portion includes an upper interior rim which encircles an interior circumference of the trash bag receptacle portion, the upper interior rim including at least a first transverse edge and a parallel oppositely disposed second transverse edge, the interior rim having a given shape;

b. the first transverse edge includes a first centrally disposed wire mounting assembly receiving member;

c. the second transverse edge includes a second centrally disposed wire mounting assembly receiving member; the first wire mounting assembly receiving member and the second wire mounting assembly receiving member are parallel to each other and are respectively affixed inwardly from a respective interior side of a respective transverse edge, both extending into a central opening of the upper interior rim;

d. a one-piece retaining wire having at least a first transverse edge and a parallel oppositely disposed second transverse edge, the shape of the retaining wire conforming to the shape of the upper interior rim;

e. affixed to a first transverse edge of the one-piece retaining wire is a first wire return assembly and affixed to the second transverse edge is a second retaining wire return assembly, each retaining wire return assembly having a return force spring and teeth engaging members, the first wire return assembly affixed inside the first centrally disposed wire mounting receiving assembly and the second wire return assembly affixed inside the second centrally disposed wire mounting receiving assembly;

f. a first locking member having an engaging tooth which engages a tooth engaging member of the first wire return assembly, the first locking member retained in the first centrally disposed wire mounting receiving assembly, and a second locking member having an engaging tooth which engages a tooth engaging member of the second retaining wire return assembly, the second locking member retained in the second centrally disposed wire mounting receiving assembly; and g. the retaining wire is press fit retained into the upper interior rim by the force of the engaged locking teeth overcoming the first and second return force springs causing their respective mounting and moving blocks to be retained against one another, a pushbutton release mechanism releases the locking force and causes the retaining wire to be elevated above the upper interior rim until a locking tooth from a first and second respective locking members engages a receiving tooth on a respective moving member to lock the retaining wire in an elevated position above the upper interior rim, and after the ends of a disposable trash bag is inserted between the retaining wire and the upper interior surface, a downward force on the retaining wire pushes the return assemblies back into their respective wire mounting receiving assembly and the locking tooth engagement retains the retaining wire against the interior rim to entrap the disposable garbage bag, a release mechanism causes each locking tooth to be released from its engagement with an engaging tooth and the force of the two return force springs causes the movable blocks to come together with their respective mounting blocks and force the retaining wire away from the interior rim, thereby releasing the entrapped open ends of the disposable trash bag.

* * * * *